US006038767A

United States Patent [19]

Ito

[11] Patent Number: 6,038,767

[45] Date of Patent: Mar. 21, 2000

[54] METHOD AND APPARATUS FOR ASSEMBLING PISTON ASSEMBLY

[75] Inventor: Shinichi Ito, Aichi-ken, Japan

[73] Assignee: Sanyo Machine Works, Ltd., Aichi-ken, Japan

[21] Appl. No.: 09/029,077

[22] PCT Filed: Aug. 7, 1996

[86] PCT No.: PCT/JP96/02243

§ 371 Date: Apr. 27, 1998

§ 102(e) Date: Apr. 27, 1998

[87] PCT Pub. No.: WO98/05865

PCT Pub. Date: Feb. 12, 1998

[51] Int. Cl.[7] ..... B23P 15/00

[52] U.S. Cl. ..... 29/888.02; 29/888

[58] Field of Search ..... 29/888.02, 888, 29/799, 822, 823, 787, 788

[56] References Cited

U.S. PATENT DOCUMENTS

| | | | |
|---|---|---|---|
| 5,101,555 | 4/1992 | Hauser | 29/888.02 |
| 5,537,743 | 7/1996 | Hibino et al. | 29/888.02 |
| 5,655,432 | 8/1997 | Wilkosz et al. | 29/888.02 |

*Primary Examiner*—I Cuda
*Attorney, Agent, or Firm*—Nikaido, Marmelstein, Murray & Oram LLP

[57] ABSTRACT

A method and apparatus to permit automatic installation of pistons and shoes on a swash plate, for reducing in costs and improving the quality of a swash plate type compressor. A slide table 52 is provided which is movable in a direction perpendicular to the axis O of a rotating shaft 2. A plurality of pistons 4 to be assembled are disposed on the slide table 52 in a manner parallel to one another. When the slide table 52 is advances, the shoes 7 disposed within a notch 4*a* in each of the pistons 4 on the slide table 52 are raised to a substantially vertical position by a presser member 54 and the piston 4 is aligned with the peripheral edge of the swash plate. A pair of heads 50 and 51 for supporting the rotating shaft 2 are provided with a shaft support portion 55 for supporting the rotating shaft 2 thereon. A plurality of piston support portions 67 for supporting the pistons are provided around the shaft support portion at circumferential positions. The pistons on the slide table 52 are supported by the piston support portions 57 in their assembled positions on the peripheral edge of the swash plate. The piston support portions 67 are unitarily rotated a predetermined pitch in synchronous with advancement of the slide table.

11 Claims, 17 Drawing Sheets

METHOD AND APPARATUS FOR ASSEMBLING PISTON ASSEMBLY

BACKGROUND OF THE INVENTION

The present invention relates to an apparatus for assembling a piston assembly and a sub-assembly of a swash plate type compressor used, for example, in an air conditioner for an automobile.

In a swash plate type air compressor, a rotating shaft 2 having thereon a swash plate arranged at a predetermined angle relative to the shaft axis, as shown in FIG. 19, is generally used. Pistons 4 arranged in parallel relative to one another are incorporated in the rotating shaft 2 at positions (for example 5) equidistant in the circumferential direction around the peripheral edges 3*a* of the swash plate. The assembly consisting of the rotating shaft 2, the swash plate 3 and the pistons 4 is in general referred to as a "piston assembly P". The rotating shaft 2 of the piston assembly P is mounted, at each end, with a shaft bushing S, a race R, a bearing B and a thrust race S', and then inserted into an axial bore 5*a* and 6*a* of each cylinder 5 and 6 of a substantially cylindrical configuration, as shown in FIG. 20, so as to form a sub-assembly A shown in FIG. 23. It is noted that each piston 4 is received within bosses 5*b* and 6*b* of each of the cylinders 5 and 6 for slidable movement in the axial direction.

In the piston assembly P, each piston 4 is formed, at its central portion, with a notch 4*a* for receiving therein the peripheral edge 3*a* of the swash plate 3. A pair of shoes 7 for clamping therebetween the swash plate 3 in the axial direction are provided in each notch 4*a*. The shoes 7 are provided in order to reduce friction between the swash plate 3 and each piston 4. To this end, each shoe includes a spherical surface 7*a* adapted to be in contact with the wall of the notch 4*a*, and a flat surface 7*b* adapted to be in surface-to-surface contact with the front-side surface or rear-side surface of the swash plate 3.

With the construction mentioned above, and when the rotating shaft 2 is rotated, each piston 4 is urged by the rotating swash plate 3 and moved in one direction. Thus, the pistons 4 are reciprocally moved in the axial direction with a phase difference therebetween, so that a quantity of compressed air may be discharged.

When assembling the piston assembly P, an assembling jig 10 shown in FIG. 21 has been used in prior art. The assembling jig 10 includes a mount 11 having a round notch, formed through the upper surface toward the bottom surface thereof, for receiving the rotating shaft 2 having the swash plate 3 thereon, and a pair of support members 13 attached to the mount 11 at its upper portion on each side thereof for pivotal movement about a corresponding shaft 12 for open-close operation. The mount 11 is provided with three holding portions 11*a* of an arcuate cross-section at equidistant positions corresponding to the positions of the pistons 4. The holding portions 11*a* are intended to support thereon the pistons 4 which extend beyond the outer peripheral diameter of the swash plate 3.

The piston assembly P is assembled using the assembling jig 10 in the following procedure.

First, the support members 13 are pivoted about their respective shafts 12 to an open position, as shown by dotted line in FIG. 21. Then, three pistons 4 are disposed on the respective three holding portions 11*a*, with the bottom surfaces 4*a*' of their notches 4*a* facing the rotating shaft 2.

A pair of shoes 7 are placed on the bottom surface 4*a*' of the notch 4*a* of a first piston 4, with the shoes being in a laid position, i. e., with the spherical surface 7*a* being in contact with the bottom surface 4*a*' of the notch 4*a*. Then, the rotating shaft 2 is displaced downwardly, with the peripheral edges 3*a* of the swash plate 3 being engaged between the adjoining ends of the pair of shoes 7. By this, the shoes 7 are raised to a substantially vertical position by means of an urging force from the swash plate 3, so that the flat surface 7*b* of the shoes 7 are contacted respectively with the front-side and rear-side surfaces of the swash plate 3, as shown in FIG. 19.

Then, the support members 13 are pivoted about their respective shaft 12 in the direction shown by an arrow mark A in FIG. 21. Thereafter, the remaining two pistons 4 are assembled on the swash plate 3. When these pistons 4 are displaced downwardly, a pair of shoes 7 disposed in each notch 4*a* are urged upwardly by the swash plate 3 to a substantially vertical position, so as to clamp the swash plate 3 therebetween in the axial direction, as shown in FIG. 19. The two pistons 4 assembled are supported by the support members 13 in the lateral direction and prevented from dislodgement. It is noted that, during assembling the above two pistons 4, the shoes 7 in each notch 4*a* are held at a position by a finger(s) of an operator, so as to prevent them from dislodgement due to the gravity.

The thus assembled piston assembly P is put into the cylinders 5 and 6, by inserting each piston 4 into the boss 5*b* and 6*b* using another inserting jig.

It is noted, however, that, when using the abovementioned assembling jig 10, the bottom surface of the notch of each of the pistons disposed at the upper portion of the swash plate, so that the shoes of such pistons may be dislodged easily. Accordingly, significant time and skill are required, in order to perform a complete assembling of the pistons.

It is also noted that adherence of dust or the like to the swash plate may easily occur, since manual operation is still employed in the assembling process. Thus, variation in quality of the pistons assemblies would be caused, thus reducing the rate of operation of the entire assembling line.

Under the circumstances, the present invention is proposed to realize a fully automatic operation for assembling the pistons and shoes to the swash plate. The present invention also realize an automatic operation for inserting the piston assembly into the cylinders, whereby the swash plate type compressor may be quickly assembled, and the quality of the product may be appropriately maintained.

SUMMARY OF THE INVENTION

In order to eliminate the above problems and to achieve the above object:

1. A method for assembling a piston assembly is provided wherein the piston assembly includes a rotating shaft having a swash plate thereon, and a plurality of pistons engaged with the peripheral edge of the swash plate, wherein a pair of shoes are disposed in a notch formed in each of the pistons at its central portion, wherein the pair of shoes are slidably engaged respectively with the front-side and rear-side surfaces of the swash plate, and wherein each piston is reciprocally moved in the axial direction of the rotating shaft by means of the pair of shoes when the swash plate is rotated. The method is featured by comprising the steps of:

arranging the plurality of pistons in parallel with one another with a predetermined distance therebetween;

moving the plurality of pistons in the circumferential direction along the periphery of the swash plate, while maintaining a predetermined distance;

during the step of moving the plurality of pistons, aligning the notch with the peripheral edge of the swash plate, as each piston reaches the peripheral edge of the swash plate; and substantially the same time as the step of aligning the notch with the peripheral edge of the swash plate, raising the pair of shoes to a substantially vertical position, so that they are oppositely disposed respectively with the front-side and rear-side surfaces of the swash plate in parallel relationship therewith.

2. In accordance with the invention, an apparatus for assembling a piston assembly is provided wherein the piston assembly includes a rotating shaft having a swash plate thereon, and a plurality of pistons engaged with the peripheral edge of the swash plate, wherein a pair of shoes are disposed in a notch formed in each of the pistons at its central portion, wherein the pair of shoes are slidably engaged respectively with the front-side and rear-side surfaces of the swash plate, and wherein each piston is reciprocally moved in the axial direction of the rotating shaft by means of the pair of shoes when the swash plate is rotated. The apparatus is featured by comprising:

a carrier mechanism including a plurality of piston receiving portions for holding the plurality of pistons in parallel relationship with one another at a predetermined distance, the carrier mechanism being movable in the circumferential direction along the periphery of the swash plate;

a loading means for loading the pair of shoes in their laid position into the notch of each of the pistons;

a guide means, disposed immediately upstream of a position where a transfer passage of the carrier mechanism and the peripheral edge of the swash plate meet together, for guiding each piston held by the carrier mechanism, so that the notch of the piston is aligned with the peripheral edge of the swash plate, as each piston reaches the peripheral edge of the swash plate; and a presser means, disposed immediately upstream of a position where the transfer passage of the carrier mechanism and the peripheral edge of the swash plate meet together, for urging adjacent ends of the pair of shoes laid in the notch against the bottom surface of the notch, so that the pair of shoes are raised to a substantially vertical position, so as to cause the pair of shoes to be oppositely disposed respectively with the front-side and rear-side surfaces of the swash plate in parallel relationship therewith.

3. The carrier mechanism of the apparatus of 2 comprises:

an outer guide disposed around the peripheral edge of the swash plate for enclosing the swash plate in the circumferential direction, with a minimum gap, between the outer guide and the periphery of the swash plate, necessary for moving each piston;

an aperture, formed in the outer guide and extending partially along the circumferential direction of the outer guide, for receiving each piston therein;

rotatable inner guides disposed respectively on opposite sides of the outer guide and including a plurality of first piston receiving portions for receiving the peripheral side surface, facing the rotating shaft, of one of the opposite ends of each of the pistons moving around the swash plate, the first piston receiving portions being disposed at a predetermined distance in the circumferential direction of each of the inner guides; and a slide table movable, in synchronous with rotational movement of the inner guides, along a transfer passage in a direction tangential to the aperture of the outer guide, the slide table including a plurality of second piston receiving portions for holding the plurality of pistons thereon in parallel relationship with one another at a predetermined distance along the direction of the transfer passage.

4. In the apparatus of 3, the second piston receiving portions are preferably arranged at an angle, so that the angle defined as between the extension line of the swash plate and the axis of each of the pistons held on the second piston receiving portions approaches 90 degrees.

5. In the apparatus of 3, the surface of each of the second piston receiving portions for supporting each piston thereon is preferably formed into a curved surface having a curvature larger than that of the diametrical surface of the pistons.

6. An apparatus for assembling a piston assembly is also provided wherein the piston assembly includes a rotating shaft having a swash plate thereon, and a plurality of pistons engaged with the peripheral edge of the swash plate, wherein a pair of shoes are disposed in a notch formed in each of the pistons at its central portion, wherein the pair of shoes are slidably engaged respectively with the front-side and rear-side surfaces of the swash plate, and wherein each piston is reciprocally moved within a cylinder in the axial direction of the rotating shaft by means of the pair of shoes when the swash plate is rotated. The apparatus is featured by comprising:

a slide table including a plurality of piston receiving portions for holding the plurality of pistons in parallel relationship with one another at a predetermined distance, the slide table being movable in a direction perpendicular to the axis of the rotating shaft;

a guide means, disposed immediately upstream of a position where a transfer passage of the slide table and the peripheral edge of the swash plate meet together, for guiding each piston held by the slide table, so that the notch of the piston is aligned with the peripheral edge of the swash plate, as each piston reaches the peripheral edge of the swash plate;

a presser means, disposed immediately upstream of a position where the transfer passage of the slide table and the peripheral edge of the swash plate meet together, for urging adjacent ends of the pair of shoes laid in the notch against the bottom surface of the notch, so that the pair of shoes are raised to a substantially vertical position, so as to cause the pair of shoes to be oppositely disposed respectively with the front-side and rear-side surfaces of the swash plate in parallel relationship therewith; and a pair of support heads including a shaft support portion for supporting the rotating shaft having the swash plate thereon, and a plurality of piston support portions, disposed at positions along the circumferential direction facing the peripheral edge of the swash plate of the rotating shaft supported by the shaft support portions, for reciprocally movable in the axial direction of the rotating shaft by means of a plunger, the support heads adapted to cause the piston support heads to be protruded outwardly so as to support each piston thereon and so as to allow each piston to be engaged with the swash plate, when the piston on the slide table has reached a position below the axis of the rotating shaft, and adapted, in synchronous with subsequent movement of the slide table, to cause the piston support portions to be unitarily rotated a predetermined pitch, while holding the pistons thereon.

7. In the apparatus of 6, the plunger for driving each piston support portion is preferably connected with a fluid supply passage for supplying working fluid from a supply source to the plunger, and wherein the fluid supply passage is provided with a change-over means for selectively communicating or blocking the supply passage.

8. In the apparatus of 7, the fluid supply passage includes a single flow passage disposed upstream of the change-over means and a plurality of flow passages disposed downstream of the change-over means which are separately connected to their respective plungers. It is preferable that the change-over means includes an outer member of a substantially cylindrical configuration and an inner member of a substantially cylindrical configuration fitted within the inner diameter of the outer member and that a fluid supply groove is formed between the outer member and the inner member, the fluid supply groove having different axial widths which vary in step-like fashion, the upstream portion of the fluid supply passage being opened in one of the outer diametrical surface of the stationary inner member facing the fluid supply groove and the inner diametrical surface of the rotatable outer member facing the fluid supply groove, while the downstream portions of the fluid supply passage being opened in the other of the outer diametrical surface and the inner diametrical surface at positions shifted in the axial direction in accordance with the axial widths of the fluid supply grooves, the outer member and the inner member being rotated relative to one another in synchronous with rotational movement of the piston support portions.

9. In the apparatus of 6, the piston receiving portions are preferably arranged at an angle, so that the angle defined as between the extension line of the swash plate and the axis of each of the pistons held on the second piston receiving portions approaches 90 degrees.

10. In the apparatus of 9, the surface of each of the piston receiving portions for supporting each piston thereon is preferably formed into a curved surface having a curvature larger than that of the diametrical surface of the pistons.

11. The apparatus of 6 may be an apparatus for assembling a sub-assembly in which a piston assembly is incorporated into a cylinder when the support heads is designed to be displaced toward and from one another, and the support heads both are provided, at their front surface, with a cylinder support portion for supporting the cylinder thereon.

In accordance with the assembling method and the assembling apparatus of the invention, each piston may be held by the carrier mechanism and moved in the circumferential direction of the swash plate. Thus, manual assembling process may be obviated in substance, so that assembling work of the pistons is simplified.

It is particularly noted that the notch of each of the pistons may be automatically aligned with the peripheral edge of the swash plate by means of the guide means, and each shoe may be automatically raised to a substantially vertical position along the swash plate by means of the presser member. Thus, the period of time required for assembling is significantly reduced. Adherence of dust or foreign materials to the shoes and swash plate is completely avoided.

It is also noted that, by constituting the carrier mechanism from the outer guide, the inner guides, and slide table, the assembling process may be further automated. Variation in quality of the piston assemblies are eliminated, and operation rate of the entire assembling line may be increased.

It is further noted that, in accordance with the apparatus of 6 or 11, the entire assembling process may be automated. Thus, the piston assembly P, as well as the sub-assembly A, may be very quickly and safely assembled. Accordingly, it is possible to increase productivity for swash plate type compressors and to significantly reduce the costs. It is also possible to avoid adherence of any foreign materials to the products, whereby quality of the products may be increased.

BRIEF DESCRIPTION OF THE DRAWINGS

For a fuller understanding of the nature and objects of the present invention, reference should be had to the following detailed description taken in connection with the accompanying drawings wherein:

FIG. 2 is a view illustrating an apparatus for assembling a piston assembly and the piston assembly as assembled, wherein

FIG. 5 is a view showing the step of assembling the piston to the swash plate, wherein

FIG. 11 shows a change-over means, wherein

FIG. 12 is a perspective view of the change-over means, wherein

FIG. 13 is a perspective view of the change-over means, wherein

FIG. 22 is a cross-sectional view of a presser member, wherein

DETAILED DESCRIPTION OF THE PREFERRED EMBODIMENTS

An assembling apparatus 1 for a piston assembly P in accordance with a first embodiment of the invention will be explained below with reference to FIG. 1 through FIG. 5A and FIG. 5B.

Figure 1:
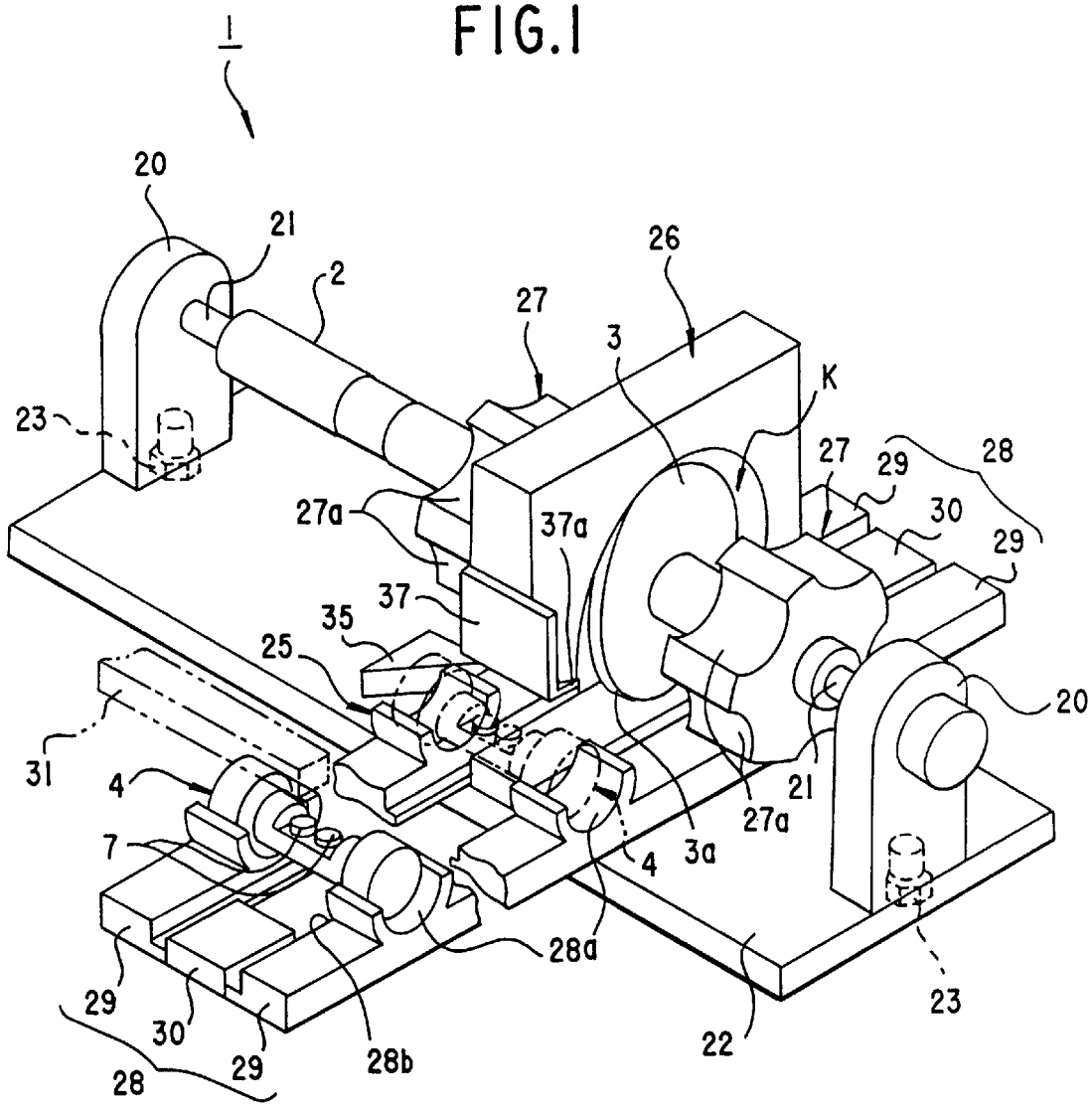
FIG. 1 is a perspective view showing the entire construction of an apparatus for assembling a piston assembly.

The assembling apparatus 1 for the piston assembly P comprises, as shown in FIG. 1, a base 22 having a pair of center stands 20 upstanding therefrom for stationarily and removably supporting a rotating shaft 2 mounted with a swash plate (the shaft 2 will be referred to as a "swash plate rotating shaft" hereinbelow), a carrier mechanism 25 for conveying pistons 4 to a position below the swash plate 3 on the swash plate rotating shaft 2 supported by the pair of center stands 20, a means 31 for loading a pair of shoes 7 into a notch 4*a* in each piston 4 being conveyed (the means 31 will be referred to as a "loading means" hereinbelow), a guide member (a guide means) 35 for guiding each piston 4 so that the notch 4*a* in each piston 4 is aligned with the periphery 3*a* of the swash plate 3, and a presser member (a presser means) 37 for urging the adjacent ends of the pair of shoes 7 disposed in the notch 4*a* in each piston 4. Since the piston assembly P to be assembled by the assembling apparatus 1 is identical in construction to the prior art piston assembly, the components of the piston assembly P are designated by the same reference numerals as used in the prior art piston assembly and will not be explained further. In FIG. 2, the loading means 31 and the guide means 35 are omitted, for convenience of illustration.

Figure 2A:
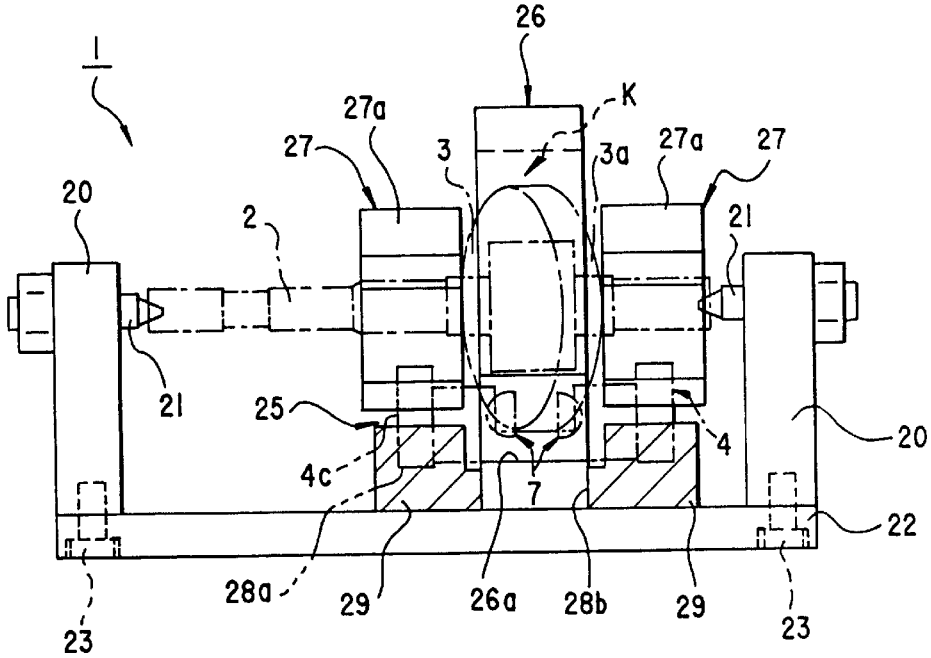
FIG. 2A is a front sectional view, in part, of the assembling apparatus.

The center stands 20 includes, as shown in FIG. 2A, center bolts 21 for non-rotatively supporting the opposite ends of the swash plate rotating shaft 2. The center stands 20 are removably secured on the base 22 by means of bolts 23.

Figure 3:
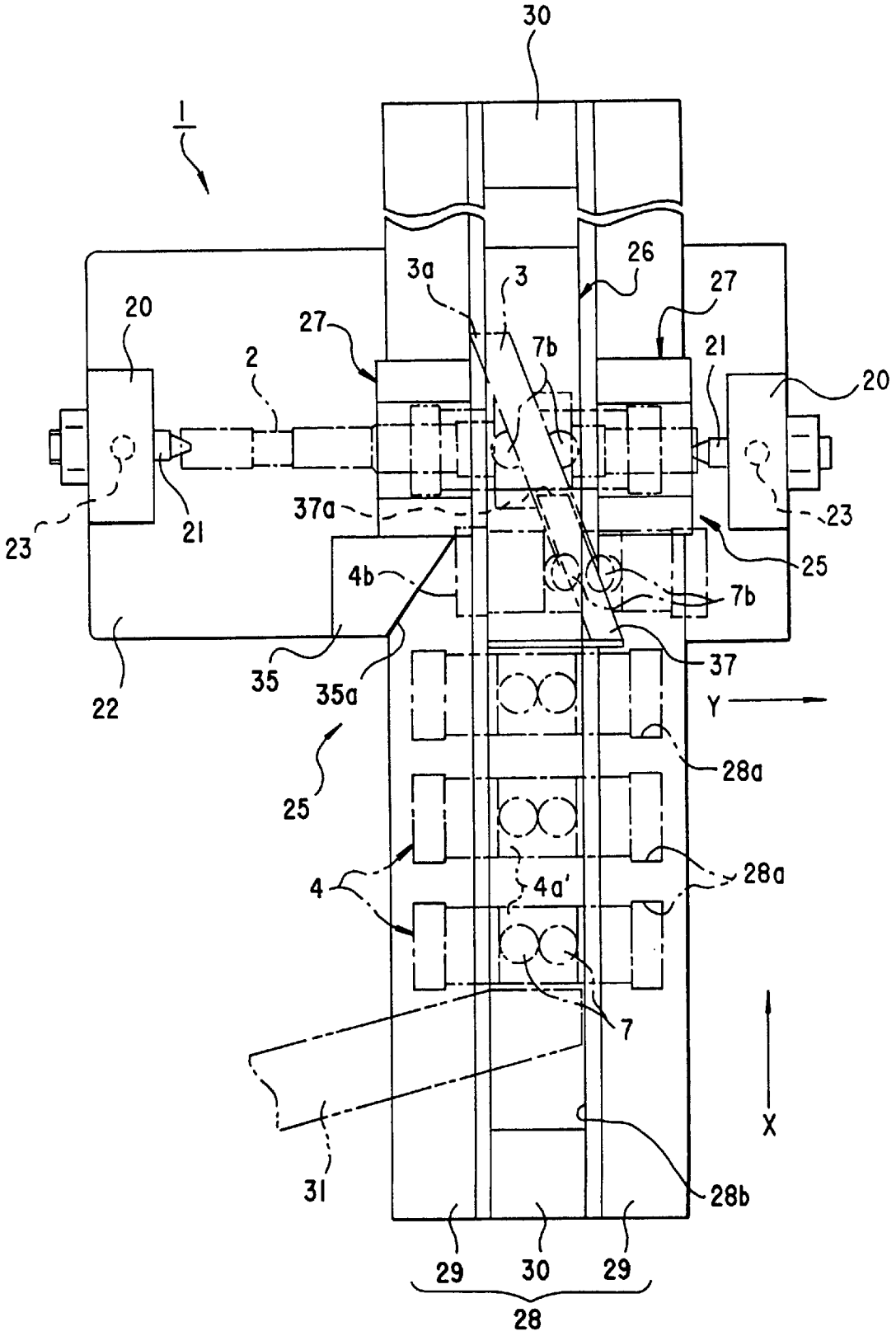
FIG. 3 is a plan view of the apparatus for assembling a piston assembly.

The carrier mechanism 25 includes, as shown in FIGS. 2A and 3, an outer guide 26 fixed to the base 22 for circumferentially encircling the swash plate 3 of the swash plate rotating shaft 2 mounted on the center stands 20, a pair of inner guides 26 mounted on the rotating shaft 2 for clamping the swash plate 3 therebetween, and slide table 28 for maintaining the piston 4 disposed at a predetermined distance from and in parallel with the outer guide 26.

Figure 4:
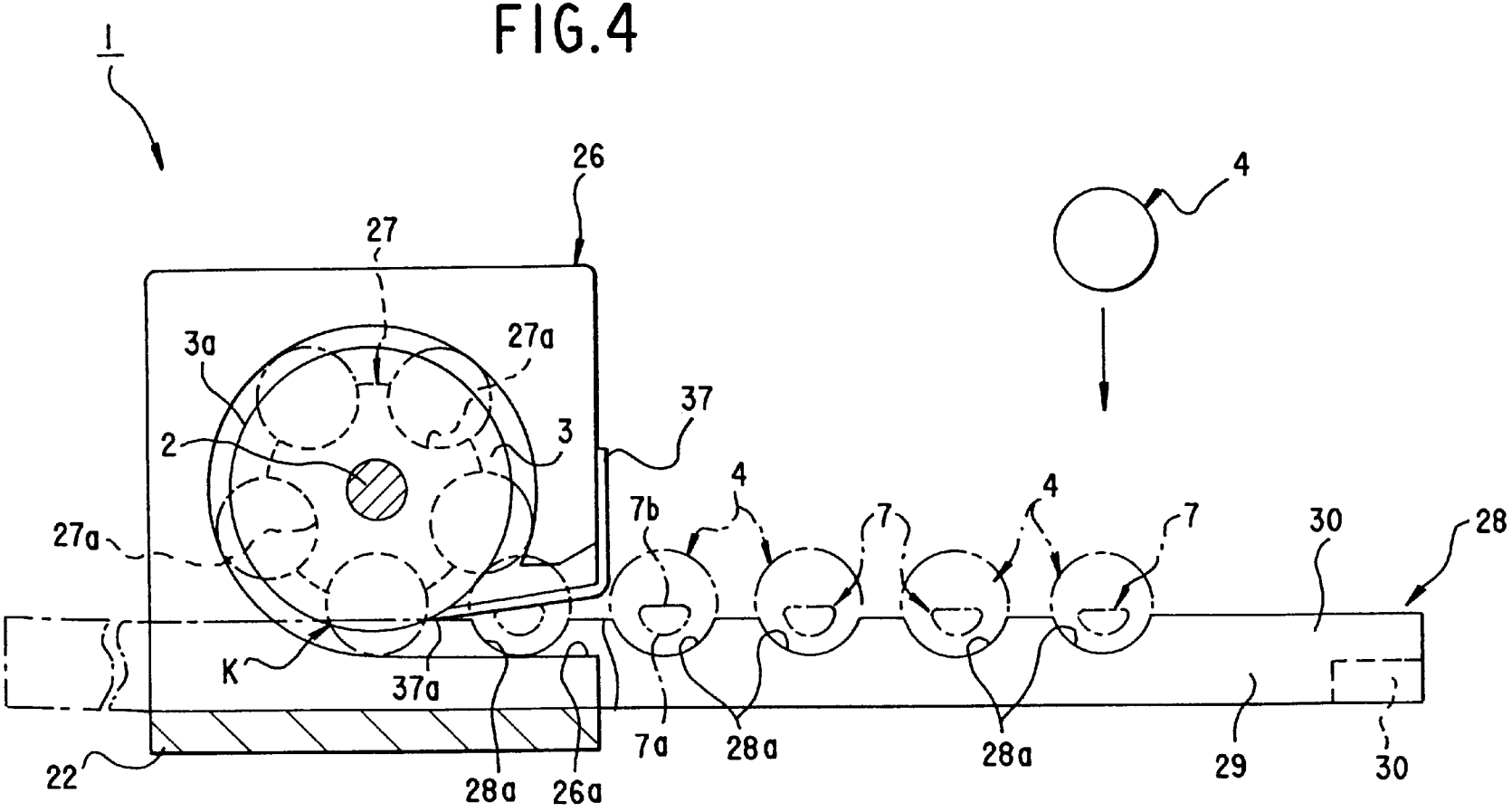
FIG. 4 is a side elevational view of the apparatus for assembling a piston assembly.

The outer guide 26 is formed, as shown in FIG. 4, at its circumferential portion at which it intersects with the slide table 28, with an aperture 26*a* for receiving the piston 4 therein. A minimum gap K for allowing the piston 4 to be moved along the periphery of the swash plate 3 is formed between the outer guide 26 and the swash plate 3.

Figure 5A:
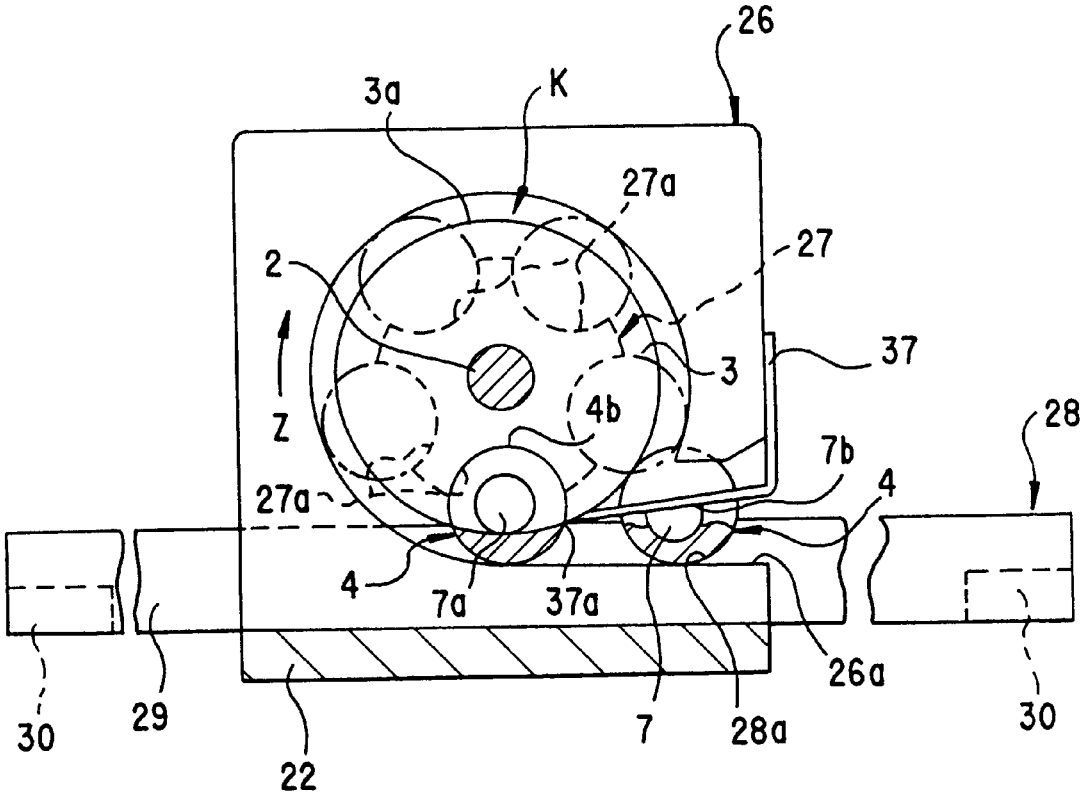
FIG. 5A is a side elevational view of the assembling apparatus.
Figure 5B:
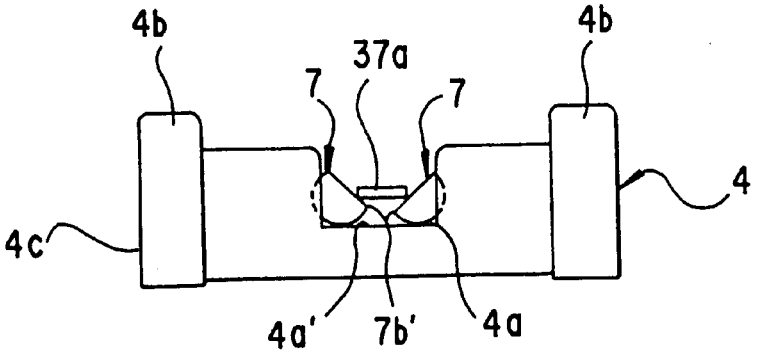
FIG. 5B is a front view of the piston of which shoes are raised to a substantially vertical position.

Each inner guide 27 is formed, as shown in FIGS. 1 and 4, with first piston receiving portions 27*a* (5 in the illustrated embodiment) equidistantly disposed in the circumferential direction and extending in the radial direction. Each first piston receiving portion 27 a has a curvature the same as that of the outer peripheral surface of each of the opposite ends of the piston 4, as shown in FIGS. 5A and 5B. It is noted that the center of each of the outer guide 26 and the inner guides 27 is disposed on the line extending between the center bolts 21 (i. e., on the center line of the rotating shaft 2).

The slide table 28 includes, as shown in FIGS. 1 and 5A, a pair of frames 29 connected through a connection plate 30. The opposite sides of the outer guide 26 are slidably engaged in a longitudinal slot 28*b* formed between the pair of frames 29. Second piston receiving portions 28*a* (5 in the illustrated embodiment) for supporting the piston 4 are formed in the upper surface of the slide table 28. The second piston receiving portions 28*a* are disposed in equidistant and parallel manner. The lower surface of the slide table 28 is slidably mounted on the base 22.

The loading means 31 may be of any construction which allows the pair of shoes 7 on the bottom surface 4*a*' of the notch 4*a* of the piston 4 held in each second piston receiving portion 28 of the slide table 28. Thus, various techniques known in the art of parts feeder may be combiningly used.

The guide member 35 includes a guide surface 35*a*, as shown in FIG. 3. The guide surface 35*a* is adapted to be engaged with one end of the piston 4 so as to cause the notch 4*a* of the piston 4 to be aligned with the peripheral edge 3*a* of the swash plate 3. The guide member 35 is disposed immediately upstream of the position where the transfer passage of the slide table 28 and the peripheral edge 3*a* of the swash plate 3 meet together. It is noted that the guide member 35 is not necessarily mounted on the base 22. For example, the guide member 35 may be mounted on the outer guide 26.

A presser member 37 is disposed immediately upstream of a position where the transfer passage of the slide table 28 and the peripheral edge 3*a* of the swash plate 3 are meet together, as shown in FIGS. 1 and 3. The presser member 37 is securely disposed on the outer guide 26 at an angle relative to the transfer passage (X in FIG. 3) of the slide table 28, so as to be arranged in parallel with the swash plate 3 installed on the rotating shaft 2. The forward end portion 37*a* of the presser member 37 disposed adjacent to the rotating shaft 2 is directed slightly downward in the opening 26*a*, as shown in FIGS. 4 and 5A.

An assembling process for assembling the piston assembly P in the assembling apparatus 1 will be explained below.

The center bolts 21 are tightened so as to cause the opposite ends of the swash plate rotating shaft 2 on the center stands 20, as shown in FIGS. 2A and 3. Before or after, or, simultaneously with the above operation, five pistons 4 are disposed in the respective second piston receiving portions 28*a* of the slide table 28 at a predetermined distance, with the notch 4*a* of each of the piston facing upwardly, as shown in FIGS. 3 and 4.

Figure 2B:
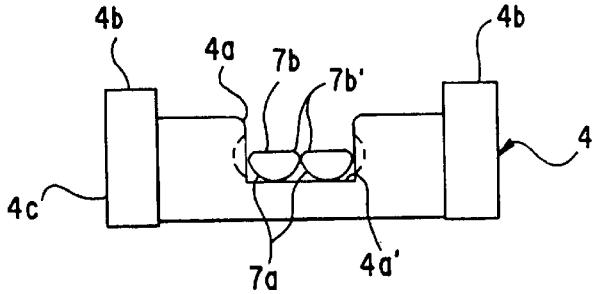
FIG. 2B is a front view showing shoes disposed on the piston.
Figure 2C:
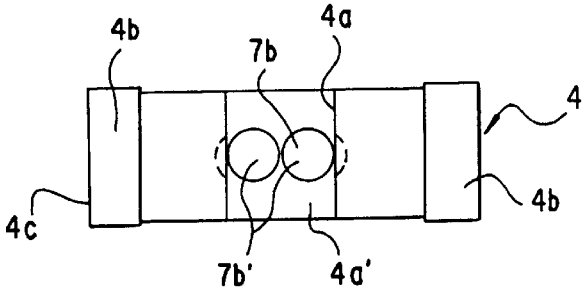
FIG. 2C is a plan view of FIG. 2B.

Then, a pair of shoes 7 are disposed on the bottom surface 4*a*' of the notch 4*a* of each of the pistons 4, as shown in FIGS. 2B, 2C and 3. At this time, each shoe 7 is laid, with its spherical surface 7*a* facing toward the bottom surface 4*a*' of the notch 4*a*.

Then, the slide table 28 is displaced along the base 22 toward the outer guide 26 in the direction indicated by X in FIG. 3. Each piston 4 on the slide table 28 is guided by the guide surface 35*a* at a position immediately upstream of the position where it meets the peripheral edge 3*a* of the swash plate 3. The piston 4 held by the second piston receiving portion 28*a* is displaced in the direction indicated by an arrow mark Y in FIG. 3. Thus, the notch 4*a* of the piston 4 is aligned with the peripheral edge 3*a* of the swash plate 3, whereby the presser member 37 is guided into the notch 4*a*. Since the forward end portion 37*a* of the presser member 37 is lowered toward its tip or forward end, the adjacent ends 7*b*' of the pair of shoes 7 laid on the bottom surface 4*a*' of the notch 4*a* is urged against the bottom surface 4*a*', as the piston 4 is moved by the slide table 28 from opening 26*a* into the outer guide 26. When the piston 4 has reached a position just below the inner guides 27, each shoe 7 is raised vertically by the presser member 37, with its spherical surface 7*a* facing outwardly toward the left-hand or right-hand direction. Thus, the opposite surfaces of the swash plate 3 are in surface-to-surface contact with the flat surfaces 7*b* of the shoes 7.

Consequently, the piston 4 is disengaged from the second piston receiving portion 28*a* of the slide table 28, whereby the outer circumferential surfaces of the opposite ends of the piston 4 are supported by the first piston guide portions 27*a* of the inner guides 27.

Since, at this time, the outer guide 26 encloses the swash plate 3 in the circumferential direction, the piston 4 is prevented from being dislodged from the first piston receiving portions 27*a* of the inner guides 28. The piston 4 is moved, together with the inner guides 27, in the circumferential direction (Z direction shown in FIG. 5A), with the bottom surface 4*a*' of the notch 4*a* facing toward the rotating shaft 2, and with the shoes 7 being slidably engaged with the opposite surfaces of the swash plate 3.

A succeeding piston 4 held in the second piston receiving portion 28*a* of the slide table 28 may also be supported between the first piston receiving portions 27*a* of the inner guides 27 and the inner peripheral surface of the outer guide 26 in an equidistant manner along the periphery of the swash plate 3, according to the abovementioned process.

When the five pistons 4 all have been mounted on the swash plate 3, the center stand 20, which supports thereon the longer portion of the rotating shaft 2, is removed from the base 22.

Then, the inner guide 27, which is disposed around the longer portion of the rotating shaft 2 is removed. Thereafter, the longer portion of the rotating shaft 2 is inserted into the axial bore Sa of the cover 5. Then, each piston 4 is inserted into a corresponding boss Sb.

The piston assembly P is then withdrawn from the outer guide 26 in the direction toward the longer portion of the rotating shaft 2. Then, the other inner guide 27 is removed from the shorter portion of the rotating shaft 2.

Figure 23:
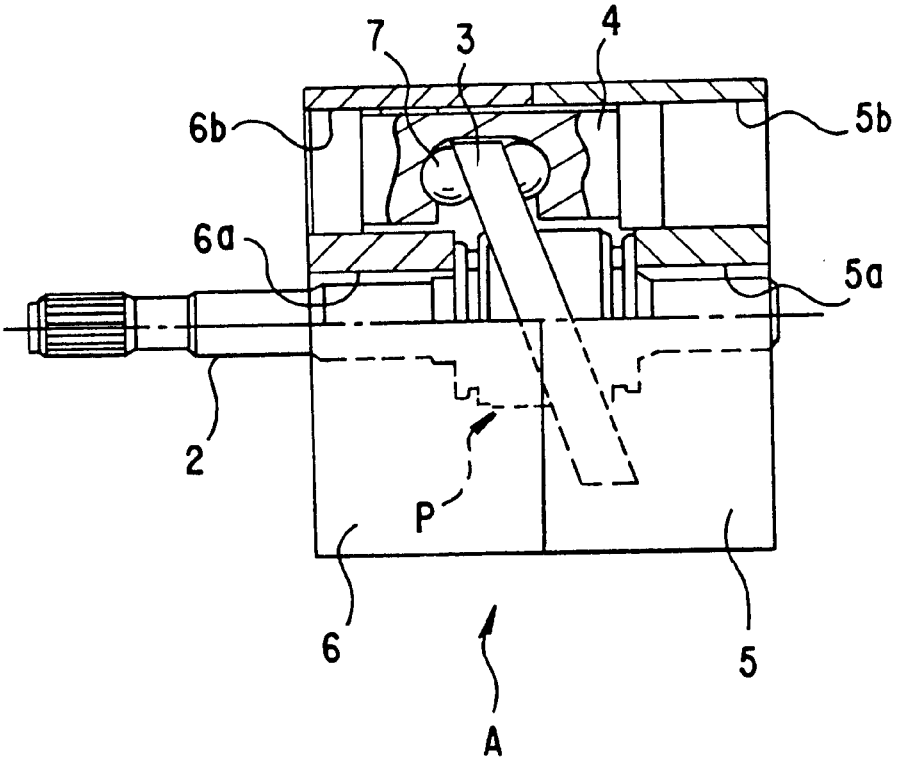
FIG. 23 is a side elevational view, in cross-section, of a part of a sub-assembly.

The shorter portion of the rotating shaft 2 is inserted into the axial bore 6*b* of the cover 6. Each piston 4 is inserted into a respective bore 6*b*, whereby the sub-assembly A shown in FIG. 23 may be obtained.

In the first embodiment of the invention just described above, the piston 4 is held by the inner guides 27 and slidably moved in the upward direction along the swash plate 3, without rotating the swash plate rotating shaft 2. It is noted, however, that another type of carrier mechanism may be employed, provided that it is of a construction in which the pistons 4 may be held in a parallel relationship at a predetermined distance and displaced in the circumferential direction along the periphery of the swash plate 3. For example, the base may be of a flexible construction (e. g., conveyor), in order to permit the pistons 4 to be held around the swash plate 3 at a predetermined distance.

As mentioned above, and in accordance with the first embodiment of the invention, the piston assembly P may be very quickly and reliably assembled, simply by mounting the pistons 4 each having the shoes 7 in the notch 4*a* on the slide table 28 and then displacing the slide table 28 toward the swash plate rotating shaft 2 secured to the base 22. Specifically, the peripheral edge 3*a* of the swash plate 3 and the notch 4*a* of each of the piston 4 are automatically aligned with each other by means of the guide member 35. Then, the pair of shoes 7 mounted on the bottom surface 4*a* of the notch 4*a* are automatically raised by means of the presser member 37 and arranged in opposite relationship with the opposite surfaces of the swash plate 3. Next, the pistons 4 may be quickly mounted around the peripheral edge 3*a* of the swash plate 3, with their axis arranged in parallel with the axis of the rotating shaft 2. Consequently, it is not necessary for an operator with his fingers to hold the pistons 4 or shoes 7, so that any less-experienced operator can easily and accurately assemble the plural pistons 4 and the swash plate rotating shaft 2. More specifically, an operator utilizing the device of the invention may assemble the piston assembly P in a period of time less than half that required when he performs manual assembling.

An assembling apparatus according to a second embodiment of the invention will be explained below with reference to FIGS. 6 to 23. This device has been further developed in relation to the first embodiment utilizing its basic concept.

Figure 6:
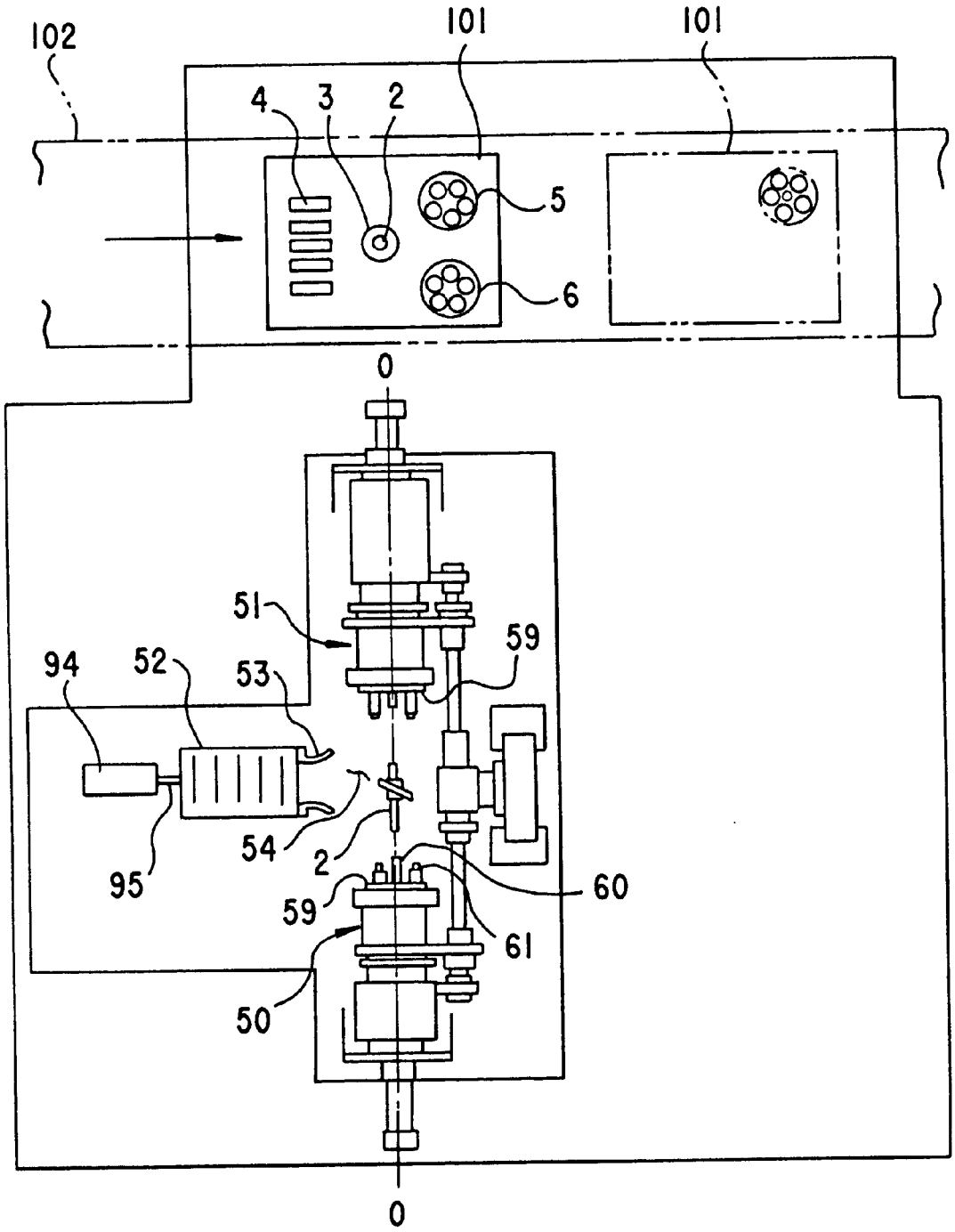
FIG. 6 is a plan view showing an apparatus for assembling a piston assembly according to another embodiment.
Figure 7:
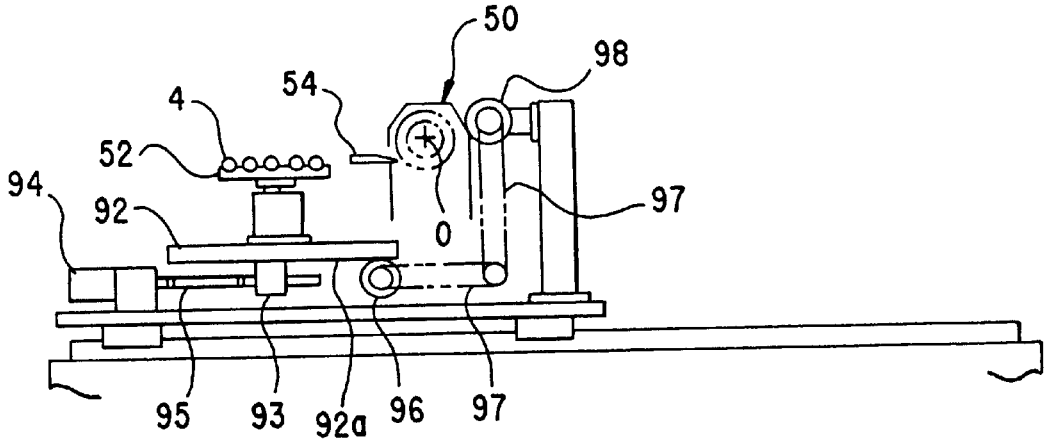
FIG. 7 is a vertical cross-sectional view showing the assembling apparatus shown in FIG. 6.

As shown in FIGS. 6 and 7, the assembling apparatus includes support heads 50 and 51 for supporting a rotating shaft 2 having a swash plate 3 (the shaft will be simply referred to a "rotating shaft" hereinbelow), a slide table 52 for holding a plurality of pistons 4 arranged in a row, a presser member 54 for raising shoes disposed in the notch of each of the piston 4 while guiding each piston 4 in a predetermined direction, and a pair of piston guides 53 for guiding each piston 4 toward the presser member 54. These components will be explained in detail below.

Figure 9:
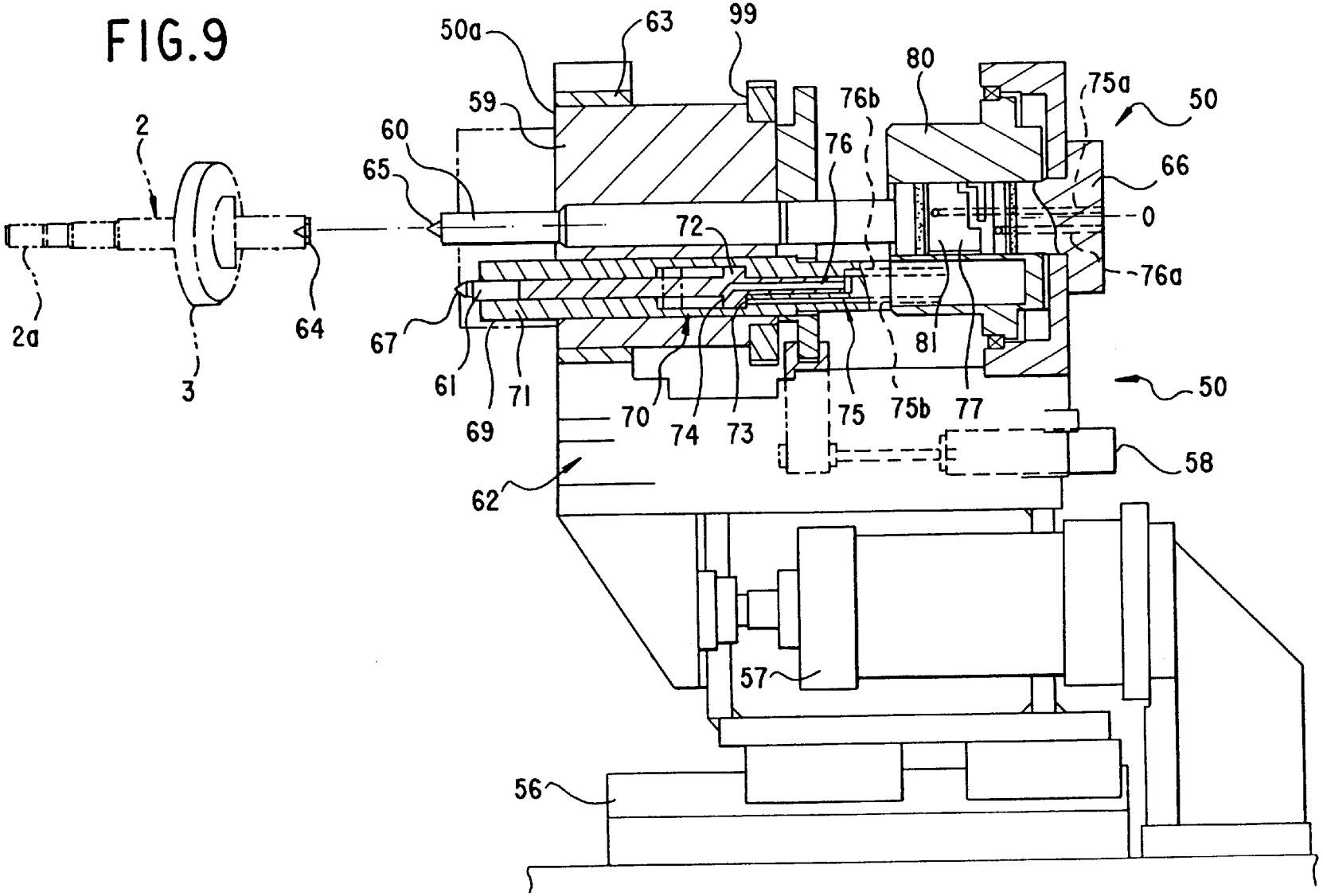
FIG. 9 is a longitudinal cross-sectional view of the rear-side support head.

The support heads 50 and 51 are oppositely disposed with each other, so that the rear-side head 50 supports the rear-side end of the rotating shaft 2, and the front-side head 51 supports the front-side end of the rotating shaft 2. The heads 50 and 51 are disposed on a rail 56 through wheels (not shown), as shown in FIG. 9. The heads 50 and 51 are movable toward and from each other by means of air cylinders 57 disposed below the heads.

Each of the support heads 50 and 51 include a rotary seat 59 rotatable about a common rotation axis O. Each rotary seat 59, which is of a substantially cylindrical configuration, is rotatably supported, through a bearing 63, on a frame 62 of the head 50. A center pin 60 and a plurality of clamp pins 61 are inserted longitudinally in the rotary seat. It is noted, however, that only one of the clamp pins 61 is shown in FIG. 9, and remaining clamp pins are not shown. An air cylinder is connected to the rotary seat 59, so that the rotary seat 59 may be reciprocally driven by the air cylinder 58 in the rotation axis O.

The center pin 60 is arranged with its axis in alignment with the rotation axis O. The center pin 60 is provided, at its forward end, with a shaft support portion 65 of a conical configuration which is engageable with a support hole 64 formed in the rearward end of the rotating shaft 2. A bearing (not shown) is disposed between the center pin 60 and the rotary seat 59. The proximal end portion of the center pin 60 is secured to the frame 62 through an engagement member 66. Thus, the center pin 60 will be held stationarily, without being rotated, when the rotary seat 59 is rotated.

Figure 8:
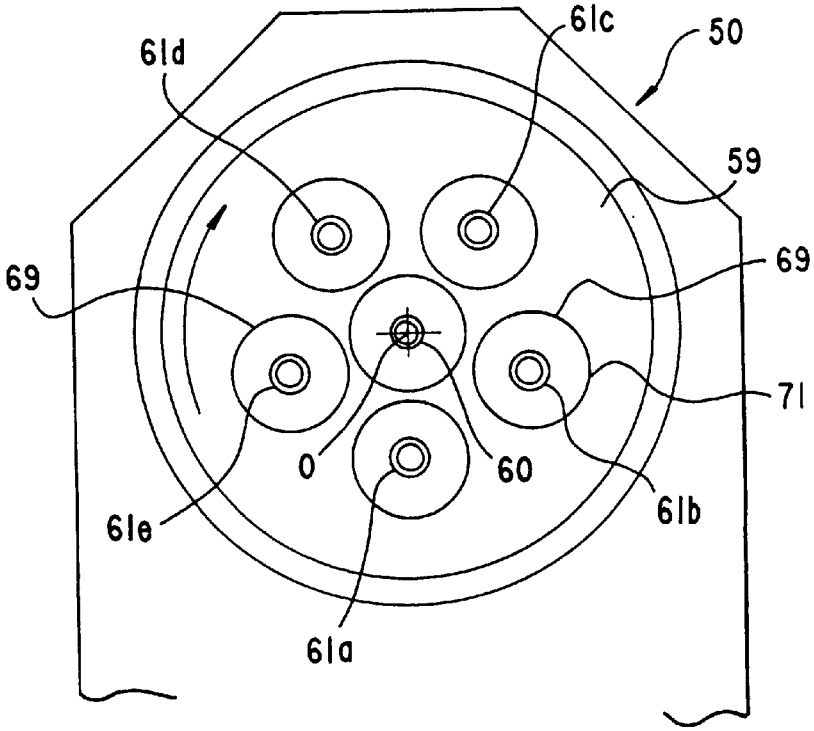
FIG. 8 is a front view of a rear-side support head.

The clamp pins 61*a*–61*e* are disposed at plural locations equidistantly distributed in the circumferential direction around the center pin 60, i. e., at the locations in which pistons 4 will be incorporated (the number of the locations is the same as that of the pistons 4 to be incorporated, i. e., five (5) in the illustrated embodiment), as shown in FIG. 8. Each clamp pin 61 is provided, at its forward end, with a piston support portion 67 of a conical configuration, as shown in FIG. 9. When the pistons are incorporated in the swash plate 3, the piston support portions 67 are engaged respectively in engagement hole (not shown) formed in the opposite end surfaces of the piston, so as to clamp the piston 4 therebetween.

Each clamp pin 61 is provided, at its proximal end, with a plunger 70 for reciprocating the pin 61 in the axial direction by means of working fluid, such as compressed air. The plunger 70 includes an outer cylinder 71 and a piston 72 fitted within the inner diameter of the outer cylinder 71 and formed integrally with the proximal end of the clamp pin 61.

The plunger 70 is of a reciprocal type, so that air supply port 73 and 74 are formed respectively on the axially opposite sides of the piston 72. When air is supplied through the supply port 73 at the proximal end of the pin, the piston 72 is urged in the left-hand direction in the drawing. By this, the clamp pin 61 is advanced, whereby a piston 4 to be assembled is clamped. On the other hand, and when air is supplied through the supply port 74 at the distal end of the pin, the clamp pin 61 is withdrawn. By this, the piston, which have been clamped as mentioned above, is unclamped.

A cylinder support portion 69 for supporting the cylinders 5 or 6 is provided in the forward surface (50*a* or 51*a*: the surface disposed oppositely to the opposite support head) of each of the support head 50 and 51. In the illustrated embodiment, the cylinder support portions 69 are provided in the outer cylinders 71 of the two clamp pins (61*b* and 61*e*: see FIG. 8) which are disposed below the rotation axis O and arranged in the same horizontal plane. Specifically, the portions of the outer cylinders 71 protruding from the rotary seat 59 toward the opposite head may be smoothly inserted into the bosses Sb and 6*b* of the cylinders 5 and 6. The above portions are designed, when inserted, to have an outer diameter of a degree of fit which prevents backlash of the cylinders 5 and 6. Thus, the cylinder 5 and 6 may be held stationarily when the cylinder support portions 69 and the bosses 5*b* and 6*b* are fitted together. Although the cylinder support portion 69 is shown in the drawing to be integrally formed with the outer cylinder 71, it may be formed as a separate portion from the outer cylinder 71.

Each plunger 70 is connected with two fluid supply passages 75 and 76 in communication with a supply of compressed air (not shown). Specifically, one is a first fluid supply passage 75 for supplying air to each plunger 70 for the purpose of clamping operation thereof. The other is a second fluid supply passage 76 for supplying air to each plunger for the purpose of unclamping operation thereof. The upstream portions of the fluid supply passages 75 and 76 are integrated respectively into passages 75*a* and 76*a*. On the other hand, the downstream portions of the fluid supply passages 75 and 76 are branched respectively into a plurality of passages 75*b* and 76*b*. The upstream portions 75*a* and 76*a* of the fluid supply passages 75 and 76 are connected to a common supply source through a respective change-over valve (not shown). The first fluid supply passage 75*b* is connected to the air supply ports 73 of the plungers for clamping operation, while the second fluid supply passage 76*b* is connected to the air supply port 74 for unclamping operation.

A change-over means 77 is disposed adjacent to the proximal end portion of the center pin 60. The change-over valve 77 is designed so as to selectively supply compressed air from a single air supply source to the plunger 70 of each of the clamp pins 61.

The change-over means 77 includes a cylindrical outer member 80 disposed coaxially with the rotary seat 59, and a cylindrical inner member 81 inserted within the outer member 80. The proximal end of each of the outer cylinders 71 is inserted into the outer member 80. Thus, the outer member 80 is rotated in unison with and in synchronous with the rotary seat 59 by means of torque from each outer cylinder 71, when the rotary seat 59 is rotated. On the contrary, the inner member 81 is integrally formed with the center pin 60 at its proximal end portion. Thus, the inner member 81, like the center pin 60, is kept stationarily, without rotation.

Figure 10:
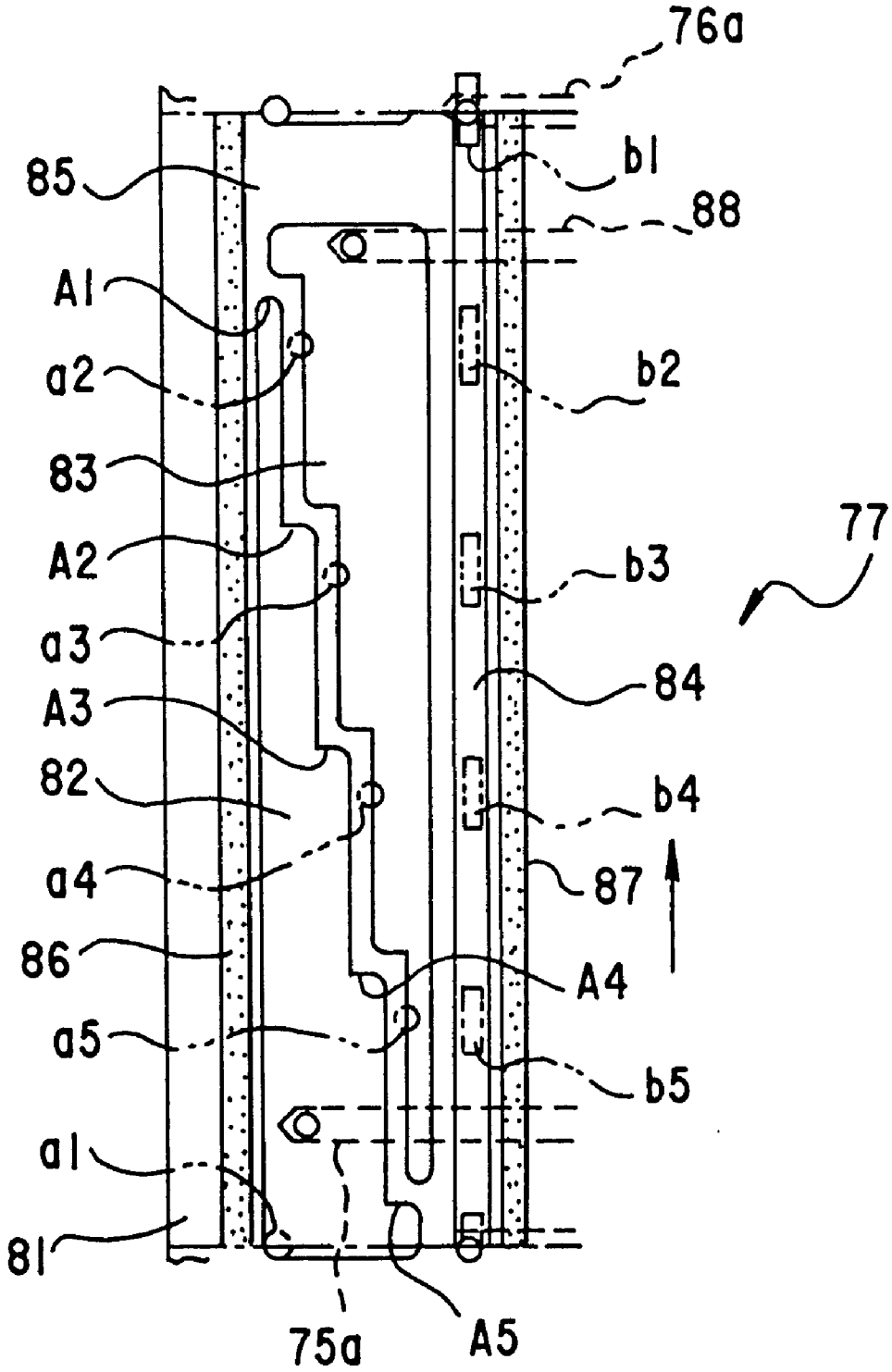
FIG. 10 is an exploded plan view of an inner member.

Three kinds of grooves 82 to 84 are formed in the outer peripheral surface of the inner member 81, as shown in FIG. 10 (a plan view of the inner member when developed). The three grooves 82 to 84 are designated, when viewed from the forward end of the center pin 60 (from the left-hand side of the drawing), as a first fluid supply groove 82, an exhaust groove 83 and a second fluid supply groove 84. The first fluid supply groove 82 and the exhaust groove 83 are partitioned by an axially extending partition 85 at one circumferential location. The second fluid supply groove 84 is formed into an annular configuration along the entire circumference of the inner member 81.

The first fluid supply groove 82 is formed into a stepped configuration having axial depths gradually reduced from the partition 85 toward the rotational direction of the outer member 80 (shown by an arrow mark in FIG. 10). Specifically, the first fluid supply groove 82 has an offset surface in the axial surfaces A1 to A5 at one of the circumferentially opposite ends (the end preceding the rotational direction of the outer member 80). The number of the axial surfaces A1 to A5 is the same as that of the piston 4 to be incorporated (five (5) in the illustrated embodiment).

The exhaust groove 83 is provided so as to prevent compressed air supplied to one plunger 70 to be supplied to the remaining plungers 70. The exhaust groove 83 is formed to have a configuration in symmetric with the first fluid supply groove 82. Specifically, the exhaust groove 83 is formed into a stepped configuration to have axial depth gradually increased toward the rotational direction of the outer member 80. The axial surface of the other one of the circumferentially opposite ends of the exhaust groove 83 (the end opposite to the rotational direction of the outer member 80) is formed into an offset surface having five (5) steps.

Seal rings 86 and 87 (shown by shaded areas) for sealingly engaging with the inner diametrical surface of the outer member 80 are provided in the outer diametrical surface of the inner member 81 at locations to hold the three grooves 82 to 84 from the axially opposite directions.

In the change-over means 77, the upstream portion 75*a* of the first fluid supply passage 75 is opened at a position in the bottom surface of the first fluid supply groove 82, while the upstream portion 76*a* of the second fluid supply passage 76 is opened at a position in the bottom surface of the second fluid supply groove 84. The exhaust passage 88 in communication with the atmosphere is opened to the exhaust groove 83.

The upstream ends a1 to a5 of the five downstream passages 75*b* of the first fluid supply passage 75 are opened in the inner diametrical surface of the outer member 80 at locations adjacent to the first fluid supply groove 82. The upstream ends a1 to a5 are equidistantly offset by a predetermined pitch in the circumferential direction. It is also noted that the upstream ends a1 to a5 are disposed at positions so as to be able to pass over the respective offset axial surfaces A1 to A5, when the outer member 80 is rotated. Specifically, the upstream end a1 passes over the axial surface A1, the upstream end a2 passes over the axial surface A2, . . . , and the upstream end an passes over the axial surface An.

The upstream ends b1 to b5 of the downstream passage 76*b* of the second fluid supply passage 76 are opened in the inner diametrical surface of the outer member 80 at equidistant locations adjacent to the second fluid supply groove 84.

Operation of the change-over means 77 will be explained below with reference to FIGS. 11A and 11B to 13A and 13B. It is noted that, in these drawings, A and B are views showing the inner member 81 from opposite directions. It is also noted that the exhaust groove 83 is omitted in each of the drawings for the purpose of simplification.

Figure 11A:
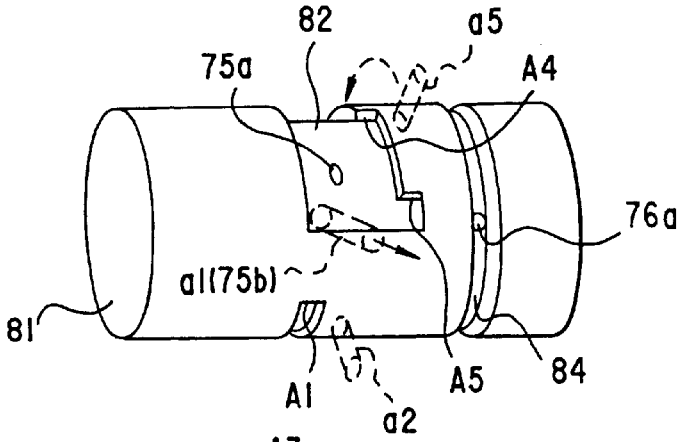
FIG. 11A is a front view of the change-over means.
Figure 11B:
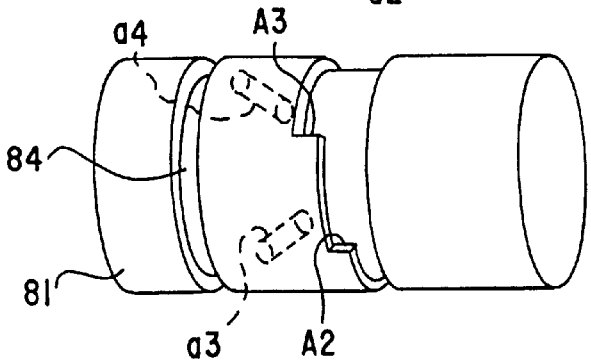
FIG. 11B is a rear view of the change-over means.

First, the above-mentioned change-over valve is changed to the clamping-side. Under the condition, the outer member 80 is rotated, so as to place the upstream end al at most forward-end side to the pin, among the upstream ends a1 to a5 of the downstream side 75*b* of the first fluid supply passage 75, oppositely to the first fluid supply groove 82, as shown in FIGS. 11A and 11B. By this, the compressed air, having been supplied from the upstream side 75*a* of the first fluid supply passage 75 to the first fluid supply groove 82, is flown through the upstream end a1 into the downstream passage 75*b* in communication with the upstream end a1, and supplied from the supply port 73 at the clamping side into the plunger 70, so as to cause the first clamp pin (61*a*: see FIG. 8) to be protruded outwardly. At this time, the remaining upstream ends a2 to a5 are closed by the outer diametrical surface of the inner member 81, so that no compressed air is flown into such supply passages, whereby the remaining clamp pins 61*b* to 61*e* are maintained at their withdrawn positions. The air leaking through the clearance between the outer member 80 and the inner member 81 is exhaust through the exhaust groove 83 adjacent the first fluid supply groove 82 into the atmosphere, so that no leak air is flown into the remaining upstream ends a2 to a5.

Figure 12A:
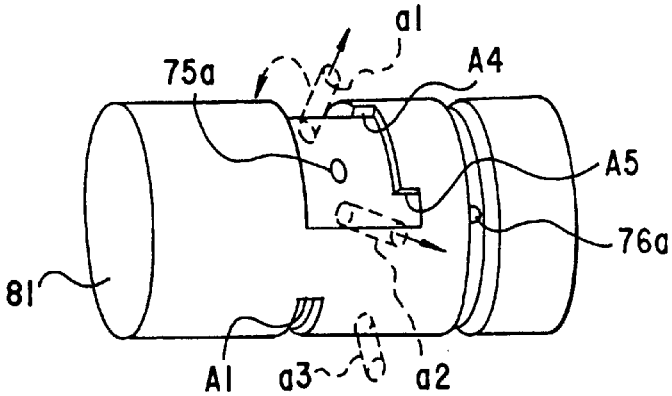
FIG. 12A is a front view of the change-over means and FIG. 12B is a rear view of the change-over means.
Figure 12B:
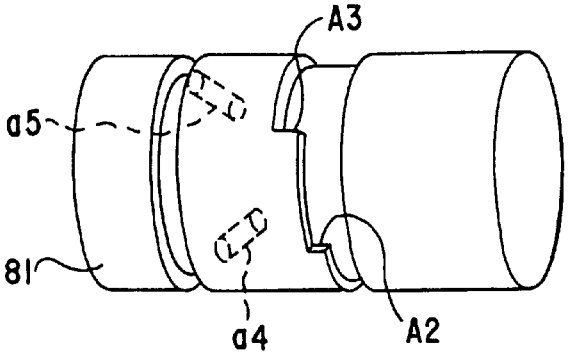

Then, the outer member 80 is rotated a predetermined pitch (72 degrees in the illustrated embodiment) in the direction shown by the dotted arrow mark. By this, the second upstream end a2 is disposed oppositely to the first fluid supply groove 82, as shown in FIGS. 12A and 12B. Thus, the second clamp pin 61*b* connected to the upstream end a2 is protruded outwardly (At this time, the first clamp pin 61*a* is maintained at its protruded position, while the remaining clamp pins 61*c* to 61*e* are maintained in their withdrawn positions).

Figure 13A:
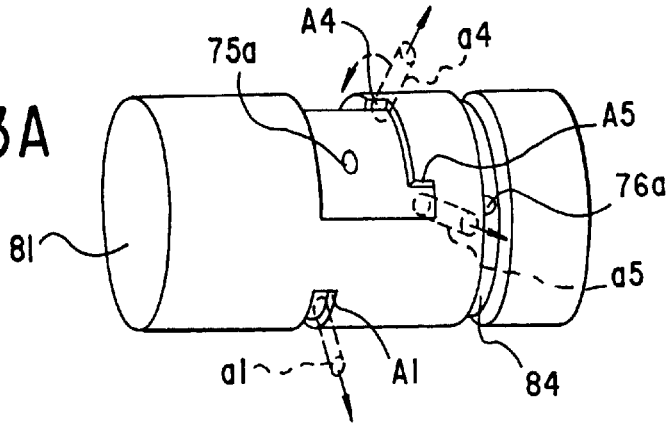
FIG. 13A is a front view of the change-over means and FIG. 13B is a rear view of the change-over means.
Figure 13B:
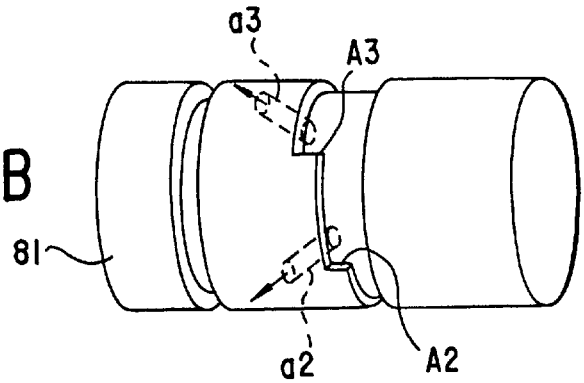

By repeating the similar operations, the remaining clamp pins 61*c* to 61*e* are sequentially protruded one by one. Finally, all upstream ends a1 to a5 are placed oppositely to the first fluid supply groove 82, as shown in FIGS. 13A and 13B, whereby all clamp pins 61*a* to 61*e* are protruded outwardly.

Under the condition, the change-over valve is changed from its clamping side to its unclamping side. By this, the compressed air supplied from the air supply source is supplied simultaneously to the upstream passage 76*a* of the second fluid supply passage and to the downstream passage 76*b*, through the second fluid supply groove 84 and the upstream ends b1 to b5. The compressed air is supplied to the supply port 74 at the unclamping side of each of the plunger 70, so that all clamp pins 61 are withdrawn simultaneously and each piston 4 having been clamped is unclamped simultaneously.

Although the operation with regard to the rear-side support head 50 is explained above, similar operation is performed at the front-side support head 51 at the same time. The three grooves 82 to 84 on the front-side are configured and arranged symmetrically with regard to the grooves on the rear-side.

In the illustrated embodiment, three kinds of grooves 82 to 84 are formed in the outer diametrical surface of the inner member 81. It is noted, however, that the grooves may be formed in the inner diametrical surface of the outer member 80. The outer member 80 or the inner member 81 may be selectively rotated. Contrariwise to the above operation, the inner member 81 may be rotated, while maintaining the outer member 80 stationarily.

Figure 14:
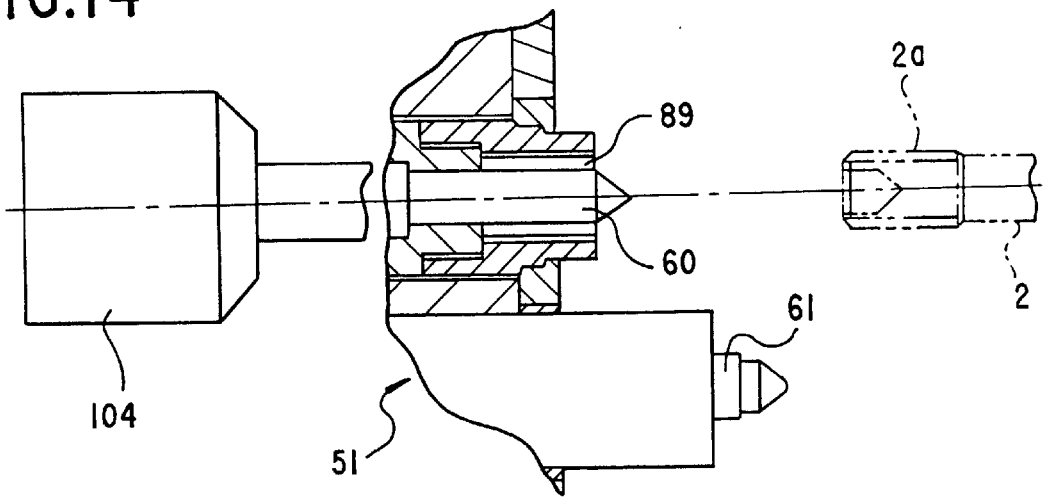
FIG. 14 is a longitudinal cross-sectional view showing a main part of a front-side support head in an enlarged scale.

As shown in FIG. 14, a serrated hole 89 is provided in the peripheral edge of the center pin 60 of the front-side support head 51. The serrated hole 89 is designed so as to be engageable with serration 2*a* provided in the front-side end portion of the rotating shaft 2. During assembling work, the rotating shaft 2 may be stationarily maintained in a predetermined assembling posture without rotation, due to the above-mentioned engagement between the serrated hole 89 and the serration 2*a*.

Figure 15B:
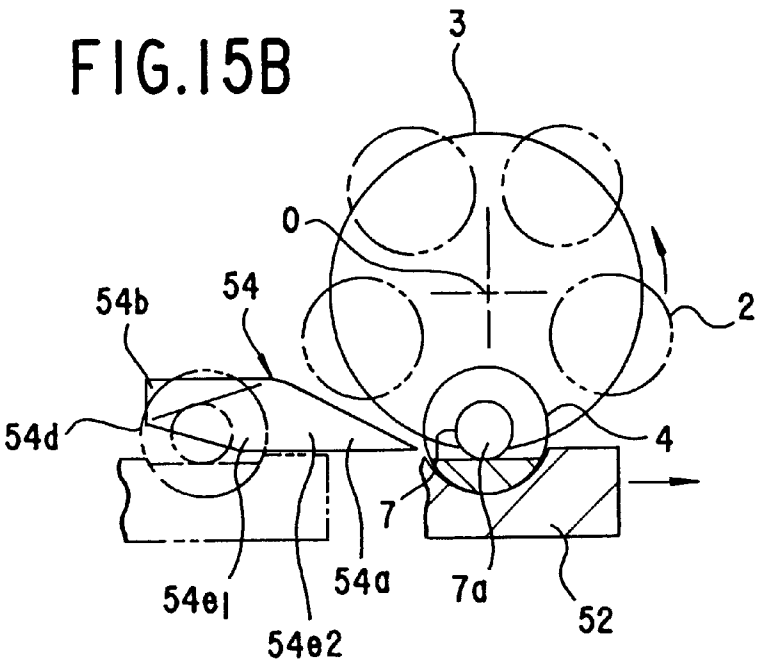
FIG. 15 is a longitudinal cross-sectional view showing the step of assembling the piston on the swash plate.
Figure 15A:
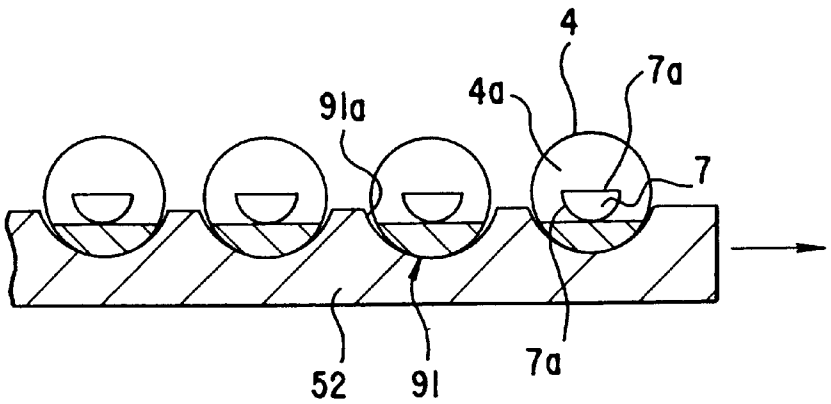
Figure 16A:
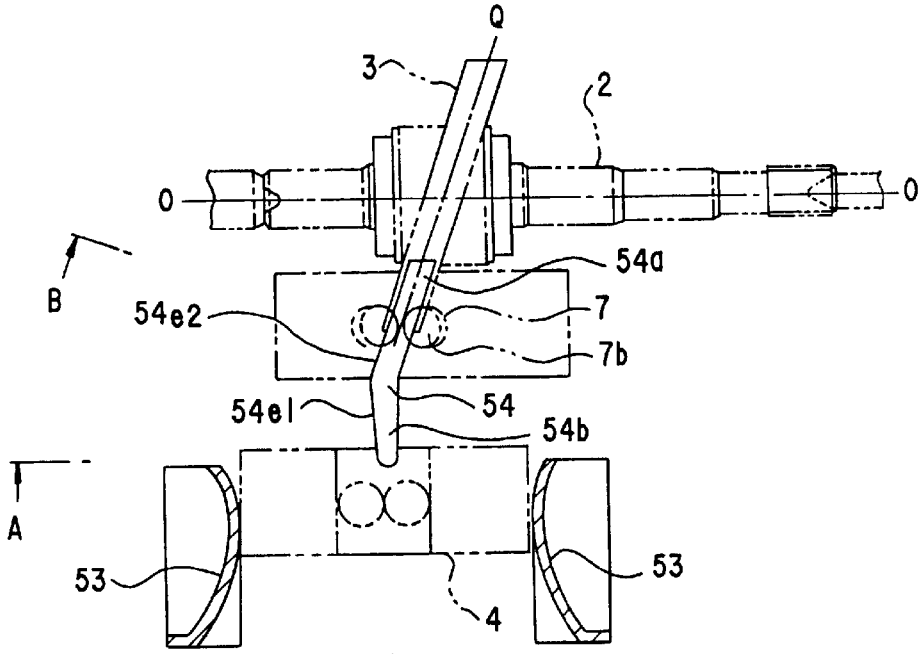
FIG. 16 is a plan view of FIG. 15.
Figure 16B:
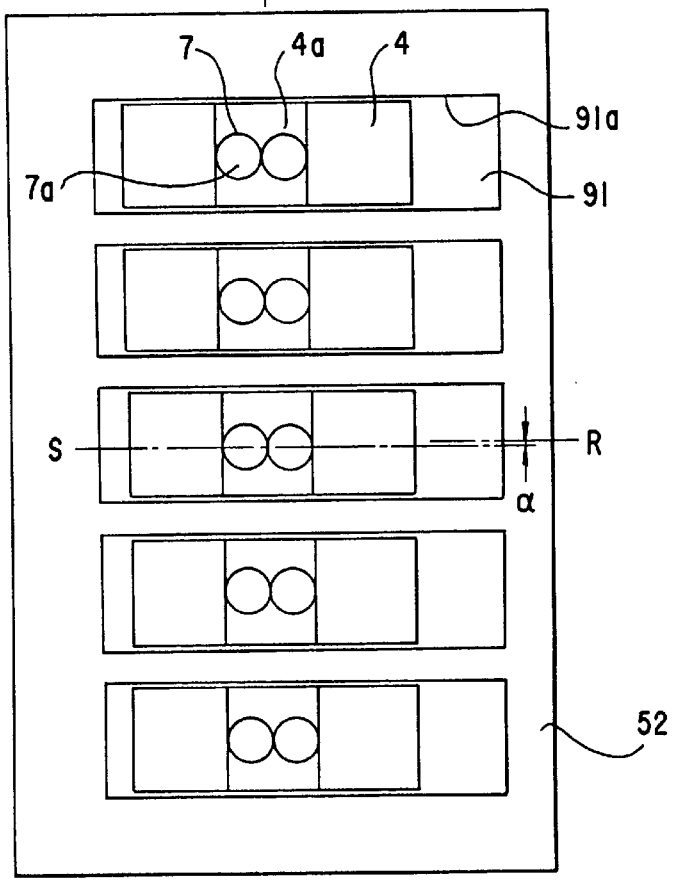

The slide table 52 includes, in its upper surface, piston receiver portions 91 for retaining a respective piston 4 thereon, as shown in FIGS. 15 and 16. The piston receiver portions 91 have an arcuate cross-section. The number of the piston receiver portions 91 is the same as that of the piston 4 to be assembled (five (5) in the illustrated embodiment). Each piston receiver portion 91 is arranged at a slight angle $\alpha$ relative to a line R in parallel with the rotational axis O, so that the angle included between the axis S of the piston 4 retained by the piston receiver portion and the extension line Q of the swash plate 3 approaches 90 degrees. This causes the flat surface 7*b* of the shoe 7 and the swash plate 3 to be brought into a parallel relationship as close as possible, when the shoe 7 is raised, so as to improve assembling property upon incorporating the pistons 4 into the swash plate 3. In this regard, it is noted that, since only a slight gap is remained between the flat surface 7*b* of the shoe 7 and the swash plate 3, interference is caused between the shoe 7 and the swash plate 3 upon assembling work, when the axis S of the piston 4 and the axis O of the rotating shaft 2 are arranged in parallel with each other. This hinders smooth assembling work. Contrariwise, and when the inclined angle $\alpha$ is maintained as mentioned above, a substantially parallel relationship may be maintained between the flat surface 7*b* of the shoe 7 and the front and rear side surfaces of the swash plate 3. This obviates interference between the shoe 7 and the swash plate 3, so that smooth assembling work may be performed. It is noted, however, that, when the inclined angle $\alpha$ of an excessive value is maintained, the piston 4 is not smoothly clamped. Thus, the inclined angle $\alpha$ should be maintained at an appropriate value (for example, 1.2 degrees).

When the pistons 4 have been assembled to the swash plate 3, the axis S of each of the pistons 4 is arranged in parallel with the rotation axis O. Thus, when the inclined angle $\alpha$ is maintained as mentioned above, the piston 4, which has been initially inclined to the rotation axis O, is slightly pivoted in the horizontal plane so as to correct its position, in order to permit the inclined angle $\alpha$ to be 0 degree. If the receiving surface 91 of the piston receiving portion 91 for supporting the piston 4 and the outer diametrical surface of the piston 4 have the same curvature and are closely contacted with each other, interference may caused between the piston 4 and the receiving surface 91*a*, so that correction for the position of the piston 4 is not permitted. Thus, it is preferable that the receiving surface 91*a* of the piston receiving portion 91 be configured to have a curvature greater than that of the outer diametrical surface of the piston, as shown in FIG. 15, so as to allow the piston 4 to be changed in its posture.

The slide table 52 is disposed on a traveling base 92, as shown in FIG. 7. A ball screw nut 93 is secured to the travelling base 92. A ball screw 95, which is driven by a servomotor 94 is inserted into the ball screw nut 93. With this construction, the slide table 52 may be reciprocally moved in a direction perpendicular to the rotation axis O by means of forward and reverse rotation of the servomotor 94.

The servomotor 94 also serves as a power source for rotationally moving the rotary seats 59 for the support heads 50 and 51. Specifically, a pinion gear 96 is disposed at a fixed position below the travelling base 92. The pinion gear 96 is in mesh with a rack 92*a* secured to the lower surface of the travelling base 92. Rotation of the pinion gear 96 is transmitted, through a transmission means 97 such as a toothed belt, to a transmission gear 98 disposed laterally of each of the support heads 50 and 51. The rotary seat 59 of each of the support heads 50 and 51 is mounted with a drive gear 99, as shown in FIG. 9. The drive gear 99 is in mesh with the transmission gear 98. With the construction, and when the servomotor 94 is actuated to move the slide table 52 a predetermined pitch in the horizontal direction, the rotary seat 59 of each of the support heads 50 and 51 may be rotated a predetermined pitch in synchronous with the slide table 52.

A presser member 54 is disposed immediately upstream of a location where the transfer passage of the slide table 52 meets the peripheral edge of the swash plate 3. The presser member 54 is formed into a substantially prismatic body which is bent into a V-shaped configuration in the horizontal plane, as shown in FIG. 15. The portion of the presser member closer to the rotating shaft 2 with regard to the bent (54*a*: referred to as a "distal portion" hereinbelow) is arranged in parallel with the extension line Q of the swash plate 3 maintained in its assembled posture, with its forward end being disposed immediately below the swash plate 3 along a direction in which the peripheral edge of the swash plate 3 is inclined, as shown in FIG. 15. The portion of the presser member further from the rotating shaft 2 with regard to the bent (54*b*: referred to as a "proximal portion" hereinbelow) is arranged in parallel with the transfer passage of the slide table 52. The lower surface of the proximal portion 54*b* is inclined downward toward the rotating shaft 2.

Figure 22A:
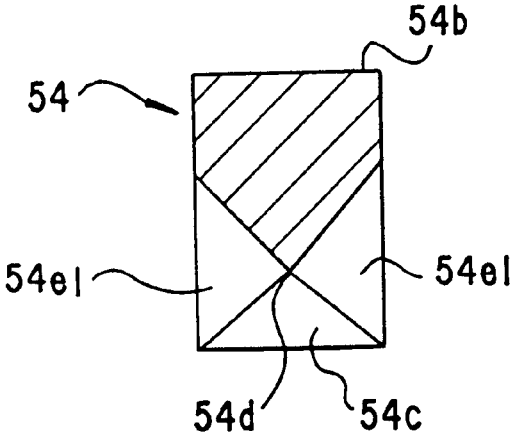
FIG. 22A shows a cross-section taken at A.
Figure 22B:
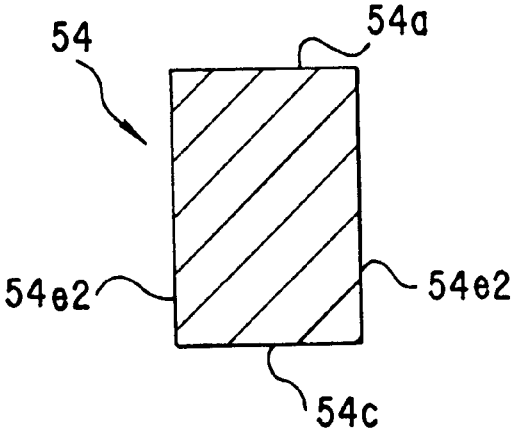
FIG. 22B shows a cross-section taken at B.

The lower surface 54*c* of the distal portion 54*a* of the presser member 54 is formed into a rectangular configuration having a width substantially the same as that of the swash plate 3, as shown in FIG. 22B. Contrariwise and as shown in FIG. 22A, the lower surface 54*c* of the proximal portion 54*b* is formed into a triangular configuration of which vertex is located at the end thereof remote from the rotating shaft 2. The end of this lower surface 54*c* is formed into a sharply pointed end 54*d*. The presser member 54 is so positioned so that the pointed end 54*d* may pass between the pair of shoes 7 disposed on the notch 4*a* of the piston 4 having been transferred by the slide table 52. When the pointed end 54*d* has been inserted between the pair of shoes 7, the slide table 52 is advanced further. By this, the adjoining ends of the shoes 7 are urged against the bottom surface of the notch 4*a* by means of the opposite side surfaces 54*e*1 of the proximal portion 54*b*. As the result, the shoes are gradually raised to a vertical position. When the shoes 7 have passed the bent of the presser member 54 to reach the distal portion 54*a*, the piston 4 is urged by the opposite side surfaces 54*e*2 of the distal portion 54*a* via the shoes 7 and moved to the right-hand side as viewed in FIG. 16. Consequently, the shoes 7 are aligned with the peripheral edge of the swash plate 3 maintained in its assembled posture.

As will be appreciated from the foregoing, the side surfaces 54*e*1 and 54*e*2 of the presser member 54 functions as a guide means for guiding the pistons 4, so as to cause the pair of shoes 7 to be aligned with the peripheral edge of the swash plate 3, and as a presser means for causing the shoes 7 laid on the notch 4*a* to be raised to a substantially vertical position. Specifically, the side surfaces 54*e*2 of the distal portion 54*a* serves as the guide means, while the side surfaces 54*e*1 of the proximal portion 54*b* serves as the presser means.

A pair of piston guides 53 are oppositely disposed at positions closer to the presser member 54 with regard to the slide table 52. The piston guides 53 guide the piston 4 so as to assure the pointed end 54*d* of the presser member 54 to be placed between the pair of shoes 7, when the elide table 52 is advanced. Thus, the piston guides 53 to be contacted with the opposite end surfaces of the piston 4 until the piston 4 is positioned at a portion of the presser member 54 just before the bent thereof.

An assembling process using the assembling apparatus will be explained below.

First, the rotating shaft 2, the pistons 4, and the rear-side and front-side cylinders 5 and 6 are mounted on a pallet 101, as shown in FIG. 6. The pallet 101 is transferred by means of a conveyer 102 to a predetermined position. It is noted that the pair of shoes have been mounted in their laid positions on the notch of the piston 4 in advance of the above-mentioned step.

Then, the two cylinders 5 and 6 are grasped by means of a chuck means (not shown). When the cylinder 5 and 6 have been transferred to a position between the support heads 50 and 51, they are supported by their respective cylinder support portions 69 provided respectively in the front surfaces of the support heads 50 and 51. Specifically, the bosses Sb and 6*b* respectively of the cylinders 5 and 6 are inserted into the respective outer cylinders 71 of the two clamp pins 61*b* and 61*e*. Consequently, the outer cylinders 71 and the corresponding bosses 5*b* and 6*b* are tightly fitted with each other, so that the cylinders 5 and 6 are securely held, with their abutment surfaces (5*c* and 6*c*: see FIG. 20) being oppositely disposed with each other. At this time, remaining clamp pins 61*a*, 61*b* and 61*c* are respectively inserted into the remaining bosses Sb and 6*b*.

Figure 17:
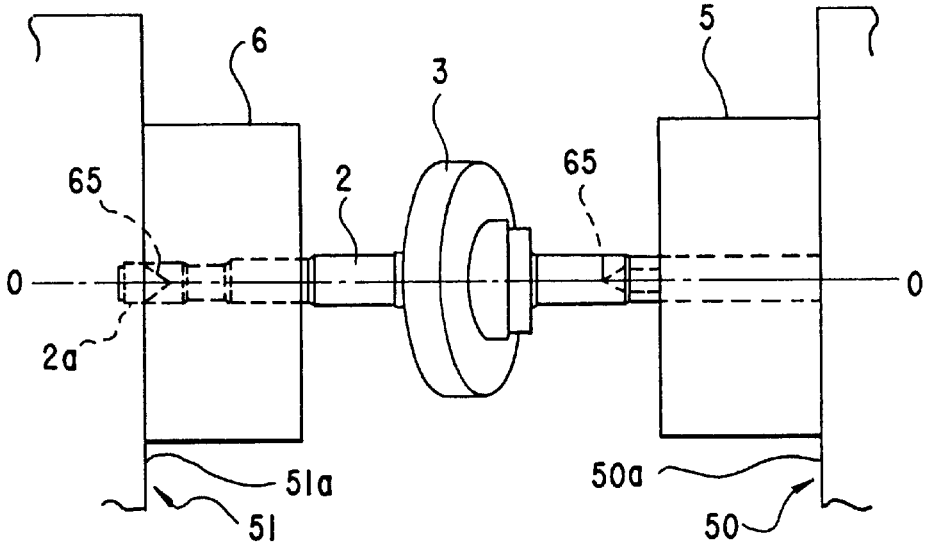
FIG. 17 is a side elevational view showing the support heads at a time just before the piston is assembled.

Then, the rotating shaft 2 on the pallet 101 is grasped by means of a chuck means (not shown) and transferred to a position between the support heads 50 and 51. The air cylinder (57: see FIG. 9) of each of the support heads 50 and 51 are actuated, so as to cause the support heads 50 and 51 to come closer relative one another. By this, the shaft support portions 65 of the heads 50 and 51 are respectively inserted into the opposite ends of the rotating shaft 2, so as to support the rotating shaft 2, as shown in FIG. 17. When the front-side shaft support portion (65: left-hand side in FIG. 17) is inserted into the end of the rotating shaft, a positioning servomotor 104 disposed at the proximal portion of the center pin 60 is actuated to cause a slight rotation of the serrated hole 89, so as to allow the serration 2*a* at the shaft end and the serrated hole 89 in the support head 51 to be aligned with each other, as shown in FIG. 14. By this, the rotating shaft and the center pin may be smoothly fitted with each other. When the shaft 2 and the center pin 60 have been fitted with each other, free rotation of the rotating shaft 2 is restricted, so that the rotating shaft 2 may be maintained in the above posture in subsequent steps. This allows easy assembling of the pistons 4.

Figure 18:
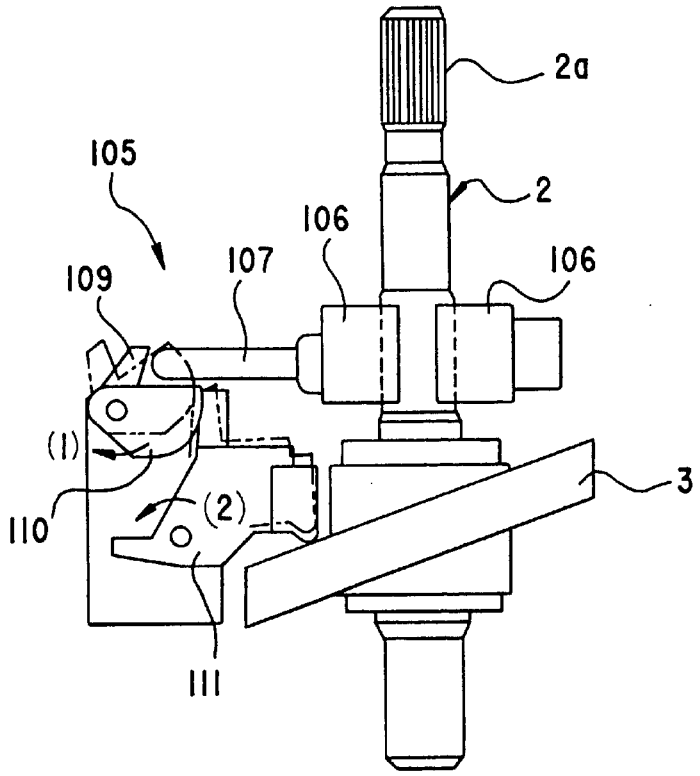
FIG. 18 is a side elevational view showing a posture maintaining mechanism provided in a chuck means for clamping the rotating shaft.
Figure 19:
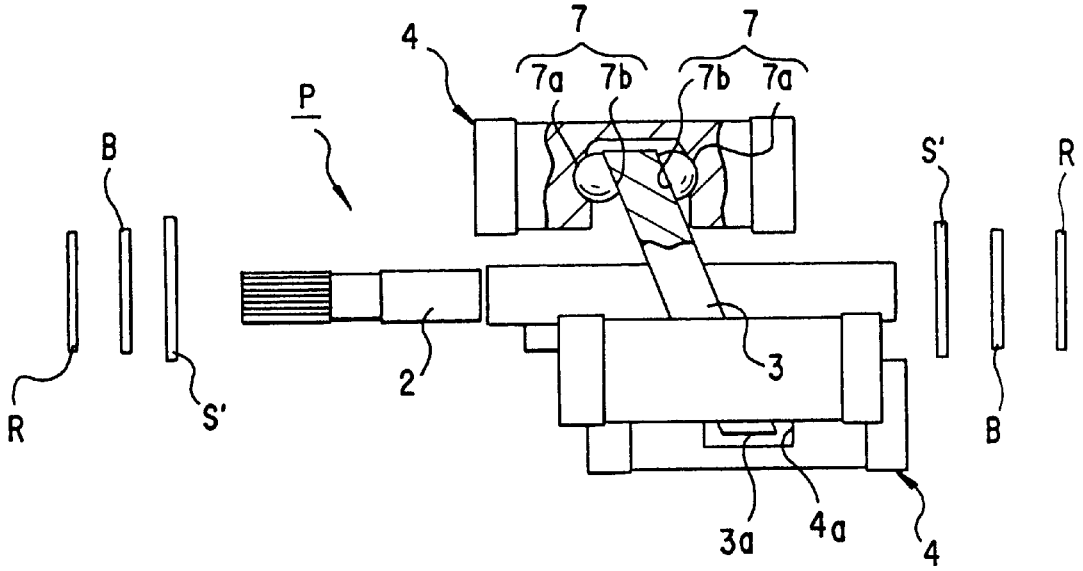
FIG. 19 is a side view, in cross-section, of a part of the piston assembly.
Figure 20:
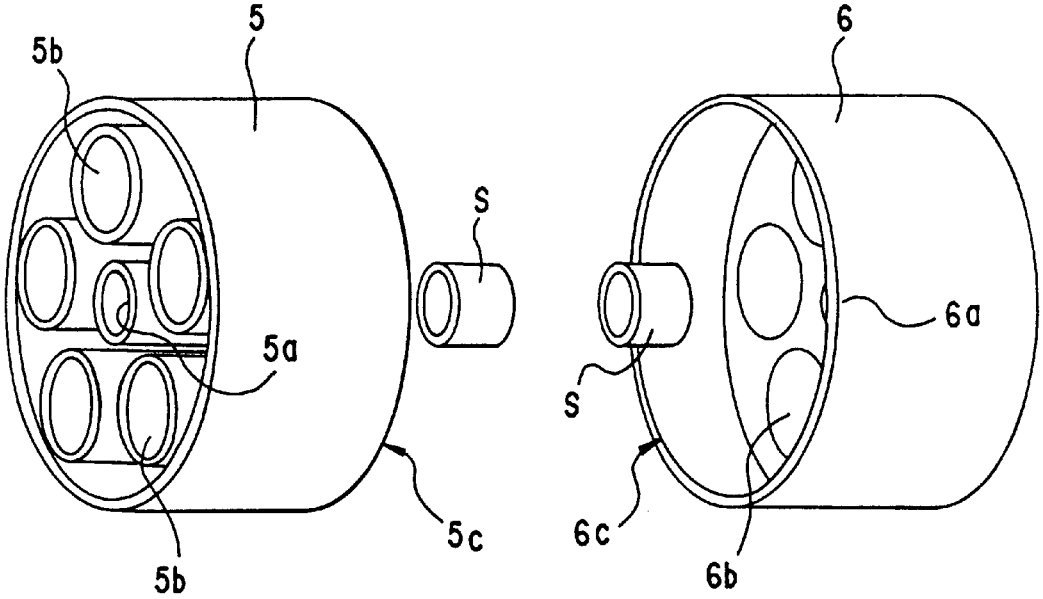
FIG. 20 is a perspective view of a cover.
Figure 21:
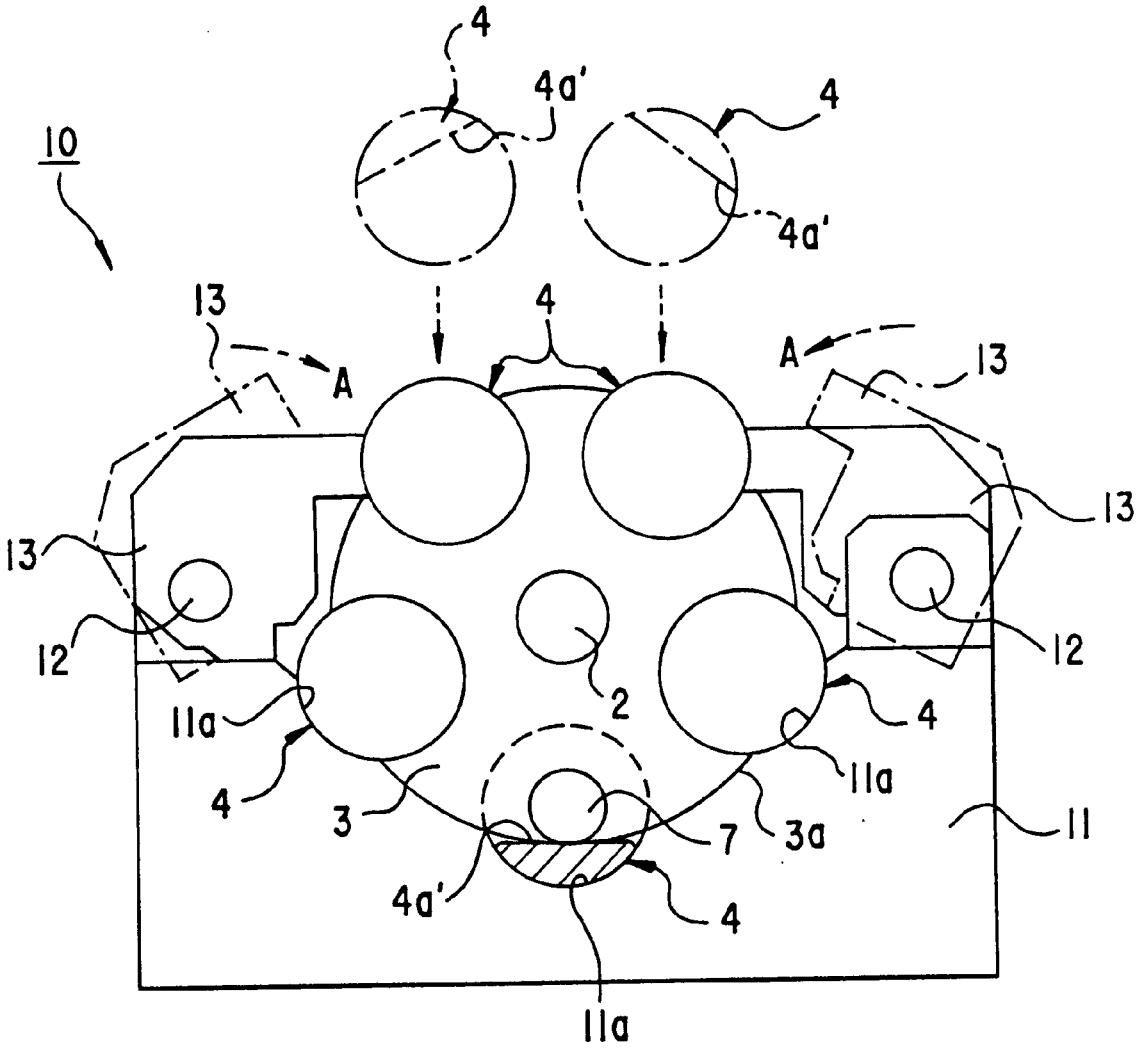
FIG. 21 is a front elevational view of an assembling apparatus in prior art.

It is noted that the rotating shaft 2 is prevented from free rotation and maintained in its proper posture by means of a posture maintaining mechanism 105 shown in FIG. 18, when the rotating shaft 2 is being transferred by the chuck means. The posture maintaining mechanism 105 includes an abuttment bar 107 attached to a chuck pawl 106 of the chuck means, a cam 110 having an abuttment portion 109 adapted to be engaged with the abuttment bar 107, and a restricting member 111 adapted to be engaged with the swash plate 3 at its two vertical positions in the plane of the drawing. When the rotating shaft 2 is clamped by the chuck pawl 106, as shown by solid line in the drawing, the abuttment bar 107 is spaced from the abuttment portion 109, so that the cam 110 is biased by a spring (not shown) in the direction shown by the arrow mark 1. As the result, the restricting member 111 is urged against the swash plate 3, so as to restrict rotation of the swash plate 3. By this, the rotating shaft 2 is maintained at a predetermined posture. When the rotating shaft 2 is unclamped, the abuttment bar 107 urges the abuttment portion 109 of the cam 110, as shown by two-dot chain line in the drawing, so as to cause the cam 110 to be rotated in the direction opposite to the arrow mark 1. Thus, the restricting member 111, being biased by a spring (not shown) in the direction shown by an arrow mark 2, is disengaged from the swash plate 3, whereby the rotating shaft 2 is allowed to be freely rotated. The rotating shaft 2 is maintained in an appropriate posture by the posture maintaining mechanism 105, until interfitment between the serration 2*a* and the serrated hole 89 has been completed and the rotating shaft 2 is fixed in a predetermined assembling posture.

Before or after the transfer of the cylinders 5 and 6 and rotating shaft 2, the piston 4 on the pallet 101 is grasped by means of a chuck means (not shown). The thus grasped piston 4 is transferred to a position above the slide table 52 and mounted onto the piston receiving portion 91. During above transfer, the shoes 7 are held on the notch 4*a* of each of the pistons 4 by an appropriate means, so that they are not dislodged therefrom.

Then, the slide table 52 is advanced toward the rotating shaft 2 maintained in its assembling posture. The first piston 4 on the slide table 52 is guided by the piston guides 53 to a position below the presser member 54. When the piston 4 has passed the proximal portion 54*b*, the pair of shoes 7 being urged by the side surfaces (urging means) 54*e*1 are raised to a substantially vertical position, with the spherical surfaces thereof facing outwardly. When the piston 4 has passed the distal portion 54*a*, the piston 4 being guided by the side surfaces (guide means) 54*e*2 is slidably moved on the piston receiving portion 91 in a direction perpendicular to the direction in which the slide table 52 is moved. By this, the notch 4*a* of the piston 4 is aligned with the peripheral edge of the swash plate 3, so that the flat surfaces 7*b* of the pair of shoes 7 are contacted respectively with the front-side and rear-side surfaces of the swash plate 3.

When the first piston 4 has reached a position immediately below the rotation axis O of the rotating shaft 2, as shown in FIG. 15, the downstream passage 75*b* and the upstream passage 75*a* of the first supply passage 75 in the change-over means 77 are put into a positional relationship shown in FIGS. 11A and 11B. Thus, the clamp pin 61*a* located at the lowermost position in FIG. 8 is protruded outwardly. By this, the piston 4 is supported by its opposite ends by means of the piston supporting portions 67 of the clamp pin 61*a*.

When the slide table 52 is advanced further, the rotary seat 59 is rotated, in synchronous with the slidable movement of the slide table 52, a predetermined pitch (72 degrees). By this, the piston 4 having been clamped in the preceding step is slidably moved on the swash plate 3 to the position 2 shown in FIG. 15. At the same time, the change-over means 77 is put into a position shown in FIGS. 12A and 12B, so that the succeeding or second piston 4 is positioned immediately below the rotation axis O of the rotating shaft 2 and clamped by the piston support portions 67 of the succeeding or second clamp pins (61*b*: see FIG. 8).

Process steps similar to those mentioned above will be repeated, whereby five (5) pistons 4 are sequentially assembled to the swash plate 3 at their equidistant positions on the peripheral edge of the swash plate 3. It is noted that each piston 4 is assembled on the swash plate 3 with a respective phase difference in the axial direction. When all piston has been assembled, the air cylinder (58: see FIG. 9) is actuated so as to cause the rotary seats 59 of the support heads 50 and 51 to be moved relative to one another. By this, the cylinders 5 and 6 are brought into abuttment while each piston 4 is inserted into the bosses 5*b* and 6*b* of the cylinders 5 and 6. Then, the change-over valve is changed to the unclamping side, so as to cause all clamp pin 61 to be withdrawn. Thereafter, the completed subassembly (A: see FIG. 23) is clamped by means of a transferring chuck means. Then, the support heads 50 and 51 are moved from one another, so as to cause the shaft support portions 65 of the center pins 60 to be disengaged respectively from the opposite ends of the rotating shaft 2. Thereafter, the chuck means is moved, so as to cause the subassembly A to be mounted on the pallet 101 disposed at the position shown by two-dot chain line in FIG. 6.

As will be appreciated from the foregoing, the piston assembly P or the subassembly A may be automatically assembled in very quick and safe manner, in accordance with the invention. Thus, producibility may be increased and production cost may be reduced. The process of the invention is performed without depending on manual operation of an operator(s), so that adherence of any foreign materials may be prevented and quality may be improved.

Although the rack 92*a*, the pinion gear 96 and belt 97 have been employed as the means for driving the slide table 52 and the rotary seats in synchronous fashion, the slide table and the rotary seats may be synchronously driven using a mechanical means such as a linkage. It is also noted that a separate servomotor may be employed as a drive source for each of the slide table and the rotary seats. Such servomotors may be electrically controlled, so as to drive the slide table and the rotary seats in synchronous fashion.

It will further be obvious to those skilled in the art that many variations may be made in the above embodiments, here chosen for the purpose of illustrating the present invention, and full result may be had to the doctrine of equivalents without departing from the scope of the present invention, as defined by the appended claims.

I claim:

1. A method for assembling a piston assembly, the piston assembly including a rotating shaft having a swash plate thereon, a plurality of pistons engaged with a peripheral edge of the swash plate, and a pair of shoes disposed in a notch formed in each of the pistons at a central portion of the piston, each of the pair of shoes being slidably engaged respectively with a front-side surface and a rear-side surface of the swash plate, wherein each piston is reciprocally moved in an axial direction of the rotating shaft by the respective pair of shoes when the swash plate is rotated, the method comprising the steps of:

arranging said plurality of pistons in parallel with one another with a predetermined distance therebetween;

moving said plurality of pistons in a circumferential direction along the peripheral edge of said swash plate, while maintaining a predetermined distance therebetween;

while moving said plurality of pistons, aligning said notch with the peripheral edge of said swash plate, as each piston reaches the peripheral edge of the swash plate; and at substantially the same time as the aligning said notch with the peripheral edge of said swash plate, raising the pair of shoes to a substantially vertical position, so that the respective pair of shoes are oppositely disposed with respect to the front-side and rear-side surfaces of said swash plate and are in parallel relationship therewith.

2. An apparatus for assembling a piston assembly, the piston assembly including a rotating shaft having a swash plate thereon, a plurality of pistons engaged with a peripheral edge of the swash plate, and a pair of shoes disposed in a notch formed in each of the pistons at a central portion thereof, each of the pair of shoes being slidably engaged respectively with a front-side surface and a rear-side surface of the swash plate, wherein each piston is reciprocally moved in an axial direction of the rotating shaft by the respective pair of shoes when the swash plate is rotated, the apparatus comprising:

a carrier mechanism including a plurality of piston receiving portions for holding said plurality of pistons in parallel relationship with one another at a predetermined distance therebetween, said carrier mechanism being movable in a circumferential direction along the peripheral edge of said swash plate;

a loading means for loading said respective pair of shoes into position in said notch of each of said pistons;

a guide means, disposed immediately upstream of a position where a transfer passage of said carrier mechanism and the peripheral edge of said swash plate meet together, for guiding each piston held by said carrier mechanism, so that said notch of said piston is aligned with the peripheral edge of said swash plate, as each piston reaches the peripheral edge of said swash plate; and a presser means, disposed immediately upstream of a position where the transfer passage of said carrier mechanism and the peripheral edge of said swash plate meet together, for urging adjacent ends of the respective pair of shoes loaded in said notch against a bottom surface of said notch, so that the respective pair of shoes are raised to a substantially vertical position, so as to cause the pair of shoes to be oppositely disposed respectively with the front-side and rear-side surfaces of said swash plate in parallel relationship therewith.

3. An apparatus for assembling a piston assembly according to claim 2, wherein said carrier mechanism comprises:

an outer guide disposed around the peripheral edge of said swash plate enclosing said swash plate in the circumferential direction, with a minimum gap between said outer guide and the peripheral edge of said swash plate sufficient for moving each piston;

an aperture, formed in said outer guide and extending partially along the circumferential direction of said outer guide, receiving each piston therein;

rotatable inner guides disposed respectively on opposite sides of said outer guide and including a plurality of first piston receiving portions receiving the peripheral side surface, facing said rotating shaft, of one of the opposite ends of each of said pistons moving around said swash plate, said first piston receiving portions being disposed at a predetermined distance in a circumferential direction of each of said inner guides; and a slide table movable, in synchronous with rotational movement of said inner guides, along a transfer passage in a direction tangential to said aperture of said outer guide, said slide table including a plurality of second piston receiving portions holding said plurality of pistons thereon in parallel relationship with one another at a predetermined distance along the direction of said transfer passage.

4. An apparatus for assembling a piston assembly according to claim 3, wherein said second piston receiving portions are arranged at a slight slant to a line parallel to a rotation axis of said rotating shaft such that an angle defined between an extension line of said swash plate and an axis of each of said pistons held on said second piston receiving portions is approximately 90 degrees.

5. An apparatus for assembling a piston assembly according to claim 4, wherein a surface of each of said second piston receiving portions supporting each piston is a curved surface having a curvature larger than a curvature of a diametrical surface of said pistons.

6. An apparatus for assembling a piston assembly, the piston assembly including a rotating shaft having a swash plate thereon, a plurality of pistons engaged with a peripheral edge of the swash plate, and a pair of shoes disposed in a notch formed in each of the pistons at a central portion thereof, each of the pair of shoes being slidably engaged respectively with a front-side surface and a rear-side surface of the swash plate, wherein each piston is reciprocally moved within a cylinder in an axial direction of the rotating shaft by the respective pair of shoes when the swash plate is rotated, the apparatus comprising:

a slide table including a plurality of piston receiving portions holding said plurality of pistons in parallel relationship with one another at a predetermined distance, said slide table being movable in a direction perpendicular to an axis of said rotating shaft;

a guide means, disposed immediately upstream of a position where a transfer passage of said slide table and a peripheral edge of said swash plate meet together, guiding each piston held by said slide table, so that said notch of said piston is aligned with the peripheral edge of said swash plate as each piston reaches the peripheral edge of said swash plate;

a presser means, disposed immediately upstream of a position where the transfer passage of said slide table and the peripheral edge of said swash plate meet together, urging adjacent ends of the pair of shoes positioned in said notch against a bottom surface of said notch, so that the pair of shoes are raised to a substantially vertical position, so as to cause the pair of shoes to be oppositely disposed respectively with the front-side and rear-side surfaces of said swash plate in parallel relationship therewith; and a pair of support heads including a shaft support portion supporting said rotating shaft having the swash plate thereon, and a plurality of piston support portions, disposed at positions along the circumferential direction facing the peripheral edge of said swash plate of said rotating shaft supported by said shaft support portions, a plunger reciprocally movable in the axial direction of said rotating shaft driving said piston support portion, said support heads adapted to cause said piston support portions to be protruded outwardly so as to support each piston thereon and so as to allow each piston to be engaged with said swash plate, when said piston on said slide table has reached a position below the axis of said rotating shaft, and adapted, in synchronous with subsequent movement of said slide table, to cause said piston support portions to be unitarily rotated a predetermined pitch, while holding said pistons thereon.

7. An apparatus for assembling a piston assembly according to claim 6 wherein said plunger for driving each piston support portion is connected with a fluid supply passage for supplying working fluid from a supply source to said plunger, and wherein said fluid supply passage is provided with a change-over means for selectively communicating or blocking said supply passage.

8. An apparatus for assembling a piston assembly according to claim 7, wherein said fluid supply passage includes a single flow passage disposed upstream of said change-over means and a plurality of flow passages disposed downstream of said changeover means which are separately connected to their respective plungers;

wherein said change-over means includes an outer member of a substantially cylindrical configuration and an inner member of a substantially cylindrical configuration fitted within an inner diameter of said outer member, a fluid supply groove being formed between said outer member and said inner member, said fluid supply groove having different axial widths which vary in step-like fashion, an upstream portion of said fluid supply passage being opened in one of an outer diametrical surface of said inner member facing said fluid supply groove and an inner diametrical surface of said outer member facing said fluid supply groove, while downstream portions of said fluid supply passage being opened in the other of said outer diametrical surface of said inner member and said inner diametrical surface of said outer member at positions shifted in an axial direction in accordance with axial widths of said fluid supply grooves, said outer member and said inner member being rotated relative to one another in synchronous with rotational movement of said piston support portions.

9. An apparatus for assembling a piston assembly according to claim 6, wherein said piston receiving portions are arranged at a slight slant to a line parallel to a rotation axis of said rotating shaft such that an angle defined between an extension line of said swash plate and an axis of each of said pistons held on said second piston receiving portions is approximately 90 degrees.

10. An apparatus for assembling a piston assembly according to claim 6, wherein a surface of each of said piston receiving portions supporting each piston thereon is a curved surface having a curvature larger than a curvature of a diametrical surface of said piston.

11. An apparatus for assembling a piston assembly according to claim 6, wherein said support heads are displaceable toward and from one another, and wherein said support heads are provided, at a front surface thereof, with a cylinder support portion supporting said cylinder thereon.

* * * * *